US009845516B2

(12) United States Patent
Steele

(10) Patent No.: US 9,845,516 B2
(45) **Date of Patent: *Dec. 19, 2017**

(54) METHOD FOR TREATING A SUBSTRATE MADE OF ANIMAL FIBERS WITH SOLID PARTICLES AND A CHEMICAL FORMULATION COMPRISING A COLOURANT

(71) Applicant: Xeros Limited, Rotherham, South Yorkshire (GB)

(72) Inventor: John Edward Steele, Rotherham (GB)

(73) Assignee: Xeros Limited, Rotherham (GB)

( * ) Notice: Subject to any disclaimer, the term of this patent is extended or adjusted under 35 U.S.C. 154(b) by 133 days.

This patent is subject to a terminal disclaimer.

(21) Appl. No.: 14/782,719

(22) PCT Filed: Apr. 11, 2014

(86) PCT No.: PCT/GB2014/051148

§ 371 (c)(1),
(2) Date: Oct. 6, 2015

(87) PCT Pub. No.: WO2014/167358

PCT Pub. Date: Oct. 16, 2014

(65) Prior Publication Data

US 2016/0032522 A1 Feb. 4, 2016

(30) Foreign Application Priority Data

Apr. 11, 2013 (GB) ..... 1306607.1

(51) Int. Cl.
*C14C 1/00* (2006.01)
*C14C 3/22* (2006.01)
(Continued)

(52) U.S. Cl.
CPC ..... *C14C 3/22* (2013.01); *C14C 1/00* (2013.01); *C14C 1/06* (2013.01); *C14C 1/08* (2013.01);
(Continued)

(58) Field of Classification Search
CPC .... C14C 3/06; C14C 3/28; C14C 3/18; C14C 3/22; C14C 1/00; C14C 1/08; D06P 7/00; D06P 1/0032; D06P 1/96; D06P 3/10
See application file for complete search history.

(56) References Cited

U.S. PATENT DOCUMENTS 3,591,326 A 7/1971 Johnels
3,806,412 A 4/1974 Gagne et al.
(Continued)

FOREIGN PATENT DOCUMENTS

CA 868968 A 4/1971
CN 2310074 Y 3/1999
(Continued)

OTHER PUBLICATIONS

U.S. Appl. No. 14/588,500, Xeros Ltd.
(Continued)

*Primary Examiner* — Eisa B Elhilo
(74) *Attorney, Agent, or Firm* — Clark & Elbing LLP

(57) ABSTRACT

The invention discloses a method for treating an animal substrate comprising: agitating the moistened animal substrate with an aqueous treatment formulation and a solid particulate material in a sealed apparatus, wherein the aqueous treatment formulation comprises at least one colorant. There is also disclosed an animal substrate obtained by the method and finished leather goods obtained by the method.

70 Claims, 7 Drawing Sheets

(51) Int. Cl.

| | |
|---|---|
| ***C14C 3/06*** | (2006.01) |
| ***C14C 3/28*** | (2006.01) |
| ***D06P 3/32*** | (2006.01) |
| ***D06P 7/00*** | (2006.01) |
| ***D06P 1/00*** | (2006.01) |
| ***D06P 1/96*** | (2006.01) |
| ***D06P 3/14*** | (2006.01) |
| ***C14C 3/18*** | (2006.01) |
| ***C14C 1/06*** | (2006.01) |
| ***C14C 1/08*** | (2006.01) |
| ***C14C 3/10*** | (2006.01) |

(52) U.S. Cl.

CPC ..... *C14C 3/06* (2013.01); *C14C 3/10* (2013.01); *C14C 3/18* (2013.01); *C14C 3/28* (2013.01); *D06P 1/0032* (2013.01); *D06P 1/96* (2013.01); *D06P 3/14* (2013.01); *D06P 3/32* (2013.01); *D06P 3/326* (2013.01); *D06P 7/00* (2013.01)

(56) References Cited

U.S. PATENT DOCUMENTS

| | | | |
|---|---|---|---|
| 4,221,564 A | 9/1980 | Plapper et al. | |
| 5,709,714 A * | 1/1998 | Natoli | C08F 265/04 8/436 |
| 6,237,373 B1 | 5/2001 | Harris et al. | |
| 8,959,961 B2 | 2/2015 | Jenkins et al. | |
| 8,974,545 B2 | 3/2015 | Burkinshaw et al. | |
| 9,017,423 B2 | 4/2015 | Burkinshaw et al. | |
| 9,121,000 B2 | 9/2015 | Burkinshaw et al. | |
| 9,127,882 B2 | 9/2015 | Jenkins et al. | |
| 9,297,107 B2 | 3/2016 | Jenkins | |
| 9,315,766 B2 | 4/2016 | He et al. | |
| 9,404,210 B2 | 8/2016 | He et al. | |
| 9,410,278 B2 | 8/2016 | He et al. | |
| 9,476,155 B2 | 10/2016 | He et al. | |
| 9,487,898 B2 | 11/2016 | He et al. | |
| 9,523,169 B2 | 12/2016 | Sawford et al. | |
| 9,550,966 B2 | 1/2017 | Burkinshaw et al. | |
| 9,587,337 B2 | 3/2017 | He et al. | |
| 9,587,340 B2 | 3/2017 | Jenkins et al. | |
| 9,631,314 B2 | 4/2017 | Yin et al. | |
| 2004/0045092 A1 | 3/2004 | Cassingham | |
| 2006/0101584 A1 | 5/2006 | Hueffer et al. | |
| 2008/0251356 A1 | 10/2008 | Bratusa et al. | |
| 2009/0205142 A1 | 8/2009 | Vorlander et al. | |
| 2011/0296628 A1 | 12/2011 | Jenkins et al. | |
| 2012/0048299 A1 | 3/2012 | Jenkins et al. | |
| 2012/0304400 A1 | 12/2012 | Jenkins et al. | |
| 2013/0061404 A1 | 3/2013 | Jenkins | |
| 2013/0167882 A1 | 7/2013 | Burkinshaw et al. | |
| 2013/0276242 A1 | 10/2013 | Jenkins et al. | |
| 2013/0283542 A1 | 10/2013 | Jenkins et al. | |
| 2013/0340487 A1 | 12/2013 | Yin et al. | |
| 2014/0123402 A1 | 5/2014 | He et al. | |
| 2014/0201929 A1 | 7/2014 | He et al. | |
| 2014/0317860 A1 | 10/2014 | He et al. | |
| 2015/0027173 A1 | 1/2015 | Wu et al. | |
| 2015/0096128 A1 | 4/2015 | Sawford et al. | |
| 2015/0096129 A1 | 4/2015 | Sawford et al. | |
| 2015/0128358 A1 | 5/2015 | Wells et al. | |
| 2015/0148278 A1 | 5/2015 | Burkinshaw et al. | |
| 2015/0152357 A1 | 6/2015 | Abercrombie et al. | |
| 2015/0152585 A1 | 6/2015 | Sawford et al. | |
| 2015/0175945 A1 | 6/2015 | Waddon et al. | |
| 2015/0252511 A1 | 9/2015 | Roberts et al. | |
| 2015/0344824 A1 | 12/2015 | Burkinshaw et al. | |
| 2016/0040260 A1 | 2/2016 | Steele | |
| 2016/0122932 A1 | 5/2016 | Wells et al. | |
| 2016/0122936 A1 | 5/2016 | Wells et al. | |
| 2016/0195409 A1 | 7/2016 | Goldberg et al. | |
| 2016/0197998 A1 | 7/2016 | Carleo | |
| 2016/0251602 A1 | 9/2016 | Steele et al. | |
| 2016/0251603 A1 | 9/2016 | Steele et al. | |
| 2016/0251795 A1 | 9/2016 | Wells et al. | |
| 2017/0051447 A1 | 2/2017 | He et al. | |
| 2017/0137983 A1 | 5/2017 | He et al. | |

FOREIGN PATENT DOCUMENTS

| | | |
|---|---|---|
| CN | 101360837 A | 2/2009 |
| CN | 102061589 A | 5/2011 |
| CN | 202175862 U | 3/2012 |
| CN | 102425053 A | 4/2012 |
| CN | 102425055 A | 4/2012 |
| CN | 202214631 U | 5/2012 |
| CN | 202214633 U | 5/2012 |
| CN | 202298219 U | 7/2012 |
| CN | 202298220 U | 7/2012 |
| CN | 202298222 U | 7/2012 |
| CN | 202298235 U | 7/2012 |
| CN | 202323458 U | 7/2012 |
| CN | 202359387 U | 8/2012 |
| CN | 202359388 U | 8/2012 |
| CN | 202359389 U | 8/2012 |
| CN | 202359390 U | 8/2012 |
| CN | 202359396 U | 8/2012 |
| CN | 202492706 U | 10/2012 |
| CN | 202543634 U | 11/2012 |
| CN | 202543635 U | 11/2012 |
| CN | 202543646 U | 11/2012 |
| CN | 202543652 U | 11/2012 |
| CN | 102899848 A | 1/2013 |
| CN | 202688698 U | 1/2013 |
| CN | 202755220 U | 2/2013 |
| CN | 202755221 U | 2/2013 |
| CN | 102953249 A | 3/2013 |
| CN | 102953250 A | 3/2013 |
| CN | 102953262 A | 3/2013 |
| CN | 102978870 A | 3/2013 |
| CN | 103061084 A | 4/2013 |
| CN | 103061085 A | 4/2013 |
| CN | 103061086 A | 4/2013 |
| CN | 103061087 A | 4/2013 |
| CN | 103087839 A | 5/2013 |
| CN | 103103720 A | 5/2013 |
| CN | 103103721 A | 5/2013 |
| CN | 103122566 A | 5/2013 |
| CN | 103122567 A | 5/2013 |
| CN | 202913242 U | 5/2013 |
| CN | 202989172 U | 6/2013 |
| CN | 103225192 A | 7/2013 |
| CN | 203049283 U | 7/2013 |
| CN | 103361934 A | 10/2013 |
| CN | 103361938 A | 10/2013 |
| CN | 203370359 U | 1/2014 |
| CN | 102061588 B | 2/2014 |
| CN | 103556439 A | 2/2014 |
| CN | 203530695 U | 4/2014 |
| CN | 203530700 U | 4/2014 |
| CN | 203530714 U | 4/2014 |
| CN | 203530718 U | 4/2014 |
| CN | 203530723 U | 4/2014 |
| CN | 203530725 U | 4/2014 |
| CN | 103285643 B | 4/2015 |
| CN | 103451894 B | 11/2015 |
| CN | 103556434 B | 11/2015 |
| CN | 103556436 B | 11/2015 |
| CN | 103556431 B | 1/2016 |
| CN | 103556432 B | 3/2016 |
| CN | 105420992 A | 3/2016 |
| CN | 105420993 A | 3/2016 |
| CN | 105421000 A | 3/2016 |
| CN | 105442267 A | 3/2016 |
| CN | 205329373 U | 6/2016 |
| CN | 205329374 U | 6/2016 |
| CN | 205329380 U | 6/2016 |
| CN | 205329384 U | 6/2016 |
| EP | 0439108 A1 | 7/1991 |
| GB | 498506 A | 1/1939 |
| GB | 874232 A | 8/1961 |
| GB | 1186368 A | 4/1970 |

(56) References Cited

FOREIGN PATENT DOCUMENTS

| | | | |
|---|---|---|---|
| GB | 1332999 | A | 10/1973 |
| GB | 1481508 | A | 8/1977 |
| GB | 2287953 | A | 10/1995 |
| JP | H01318100 | A | 12/1989 |
| JP | 2003017457 | A | 1/2003 |
| JP | 2009148699 | A | 7/2009 |
| RO | 98565 | B1 | 3/1990 |
| RU | 2206619 | C1 | 6/2003 |
| SU | 720020 | A1 | 3/1980 |
| WO | WO-88/10317 | A1 | 12/1988 |
| WO | WO-2004/061136 | A1 | 7/2004 |
| WO | WO-2009/153345 | A2 | 12/2009 |
| WO | WO-2010/094959 | A1 | 8/2010 |
| WO | WO-2011/064581 | A1 | 6/2011 |
| WO | WO-2011/098815 | A1 | 8/2011 |
| WO | WO-2011/128676 | A1 | 10/2011 |
| WO | WO-2012/056252 | A2 | 5/2012 |
| WO | WO-2014/080192 | A1 | 5/2014 |
| WO | WO-2014/147391 | A1 | 9/2014 |
| WO | WO-2014/167359 | A2 | 10/2014 |

OTHER PUBLICATIONS

U.S. Appl. No. 14/588,510, Xeros Ltd.
U.S. Appl. No. 14/777,559, Xeros Ltd.
U.S. Appl. No. 14/777,568, Xeros Ltd.
U.S. Appl. No. 14/777,573, Xeros Ltd.
U.S. Appl. No. 14/782,729, Xeros Ltd.
U.S. Appl. No. 14/902,498, Xeros Ltd.
U.S. Appl. No. 14/902,506, Xeros Ltd.
International Search Report and Written Opinion for International Patent Application No. PCT/GB2014/051148, dated Oct. 17, 2014 (11 pages).
International Search Report and Written Opinion for International Patent Application No. PCT/GB2014/051150, dated Oct. 17, 2014 (12 pages).
Search Report for United Kingdom Application No. GB1306607.1, dated Aug. 29, 2013 (5 pages).
U.S. Appl. No. 15/344,120, He et al.
U.S. Appl. No. 15/510,569, Xeros Ltd.
U.S. Appl. No. 15/510,576, Xeros Ltd.
U.S. Appl. No. 15/513,014, Xeros Ltd.
U.S. Appl. No. 15/513,309, Xeros Ltd.
U.S. Appl. No. 15/518,047, Xeros Ltd.
U.S. Appl. No. 15/532,137, Xeros Ltd.
Afsar et al., "An investigation about the effect of oxazolidine on modified valonia extract tanning," African Journal of Biotechnology. 7(20):3737-42 (2008).
Jing et al., "A novel oxazolidine tanning agent and its use in vegetable combination tanning," The Journal of the Society of Leather Technologists and Chemists 95(4):165-70 (2011).
Musa et al., "Studies on combination tanning based on henna and oxazolidine," The Journal of the American Leather Chemist's Association 104(10):335-43 (2009).

* cited by examiner

A) Process 1A: 100% Water: 0% Beads.

Process 4A: 75% Water: 25% Beads

B) Process 1A: 100% Water: 0% Beads.

Process 3A: 50% Water: 50% Beads.

C) Process 1A: 100% Water: 0% Beads.

Process 2A: 25% Water: 75% Beads.

Shades of dyed crust-leather samples
(Trupocor brilliant red 2B, Trumple Gmbh.)

| Dye quality applied (w/w) | Samples dyed in 150% water (control 1) | Samples dyed in beads 140% + water 10% (bead-water process) | Samples dyed in 10% water, no beads (control 2) |
|---|---|---|---|
| 0.50% |  |  |  |
| 1.0% |  |  |  |
| 1.5% |  |  |  |
| 2.0% |  |  |  |

TRUPOCOR Red EN (S:W:B = 10:1:14)

TRUPOCOR Red EN (S:W:B = 10:15:0)

TRUPOCOR Red EN (S:W:B = 10:1:0)

TRUPOCOR Brown GST (S:W:B = 10:1:14)
[Modified Process]

TRUPOCOR Brown GST (S:W:B = 10:15:0)
[Modified Process]

TRUPOCOR Brown GST (S:W:B = 10:1:0)
[Modified Process]

METHOD FOR TREATING A SUBSTRATE MADE OF ANIMAL FIBERS WITH SOLID PARTICLES AND A CHEMICAL FORMULATION COMPRISING A COLOURANT

This invention relates to an improved method for treating a substrate and particularly wherein said method comprises treating a substrate that is derived from an animal. The invention relates in particular to a method for treating an animal substrate by applying a colourant thereto. The colourant can be a dye or pigment. Embodiments of the invention can also encompass other process or treatment steps performed prior or subsequent to the treatment for applying a colourant to the animal substrate.

BACKGROUND

Current methods for treating or processing animal substrates such as skins, hides, pelts, and leather necessitate the use of vast quantities of water. For example, in treatment methods wherein the animal substrate comprises a hide, typically 30 kg of water is required per kg of hide. Large volumes of water are needed in order to remove unwanted materials from the animal substrate (such as those that are liable to decomposition) and in subsequent steps of the process which involve chemical modification to confer certain properties on the animal substrate. Chemical modification of the substrate may be carried out for the purpose of, inter alia, preserving, waterproofing, colouring and/or providing any desired textural or aesthetic qualities. The various steps described above will generally be performed in the presence of a treatment formulation comprising one or more components. Large volumes of water can also be required in conventional steps or processes of adding a colourant to such an animal substrate.

Due to the large quantity of water relative to the weight of animal substrate, current treatment processes known in the art require a commensurate increase in the amount of chemicals used in the treatment formulation to ensure an effective treatment of the substrate within an acceptable timeframe. Consequently, excessive amounts of polluting and environmentally damaging effluents can be produced from such processes. Furthermore, because only low levels of mechanical action can be used to avoid damaging the animal substrate, long process times can be necessary.

Many of the methods for preparing animal substrates for human use still remain predominantly based on traditional processes and there have been few advances in recent years. For example, methods for the processing and manufacturing of leather have remained largely unchanged for 75 years. EP0439108 filed in 1991 and directed to a process using carbon dioxide for deliming of hides, discloses an example of one of the few recent developments in this field.

Prior to the development of the method disclosed herein, the inventors have previously addressed the problem of reducing water consumption in a domestic or industrial cleaning method. Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. However, although the process disclosed therein relates to an improved means for cleaning a soiled substrate requiring less water, the application does not disclose a method or process for treating an animal substrate.

There is therefore needed an improved method for treating or preparing an animal substrate which ameliorates or overcomes the above-noted problems associated with the methods of the prior art. In particular there is a need for an improved method of treating an animal substrate by adding a colourant to an animal substrate. Particularly, there is needed a method for treating an animal substrate which can require less water than the methods of the prior art and that can reduce the volume of polluting and hazardous effluent produced from such a method. Furthermore, there is a desired a method for treating an animal substrate which can be advantageous in being faster, more efficient and in providing a substrate with improved properties when compared with methods of the prior art. Still further there is desired for a method of treating an animal substrate which can provides a substrate which can have one or more of the following properties:

i. Deeper penetration of the treatment formulation into the animal substrate;
ii. More uniform treatment of the surface of the animal substrate;
iii. Improved fixation of the treatment formulation components into the animal substrate;
iv. Improved surface aesthetics including feel and appearance; and
v. Improved longevity of the final treated substrate.

BRIEF SUMMARY OF THE DISCLOSURE

According to a first embodiment of the present invention there is provided a method for treating an animal substrate comprising: agitating the moistened animal substrate with an aqueous treatment formulation and a solid particulate material in a sealed apparatus, wherein the aqueous treatment formulation comprises at least one colourant. Thus embodiments of the invention the method of treating an animal substrate can comprise applying a colourant thereto.

In some preferred embodiments the animal substrate can be hide, skin or leather.

In some preferred embodiments the sealed apparatus can comprise a treatment chamber in the form of a rotatably mounted drum or a rotatably mounted cylindrical cage. The method can comprise agitating said animal substrate and said treatment formulation by rotating said treatment chamber.

In some preferred embodiments at least some of the colourant applied to the animal substrate can originate from the treatment formulation.

In some preferred embodiments wherein substantially all of the colourant applied to the animal substrate can originate from the treatment formulation.

In some preferred embodiments the colourant can be selected from one or more dyes, pigments, optical brighteners or mixtures thereof.

In some preferred embodiments the colourant can be one or more dyes selected anionic, cationic, acidic, basic, amphoteric, reactive, direct, chrome-mordant, pre-metallised and sulphur dyes.

In some preferred embodiments the animal substrate can be moistened by wetting so as to achieve a water to animal substrate ratio of from about 1000:1 to about 1:1000 w/w. The animal substrate can be moistened by wetting so as to achieve a water to animal substrate ratio of from about 1:100 to about 1:1 w/w In some preferred embodiments the ratio of water to animal substrate in the treatment formulation can be from at least 1:40 w/w to about 10:1 w/w.

In some preferred embodiments the ratio of water to solid particulate material in the treatment formulation can be from about 1000:1 to about 1:1000 w/w. In some preferred embodiments the ratio of water to solid particulate material in the treatment formulation can be from about 1:1 to about 1:100 w/w.

In some preferred embodiments the ratio of the solid particulate material to the animal substrate can be from about 1000:1 to about 1:1000 w/w. In some preferred embodiments the ratio of the solid particulate material to the animal substrate can be from about 5:1 to about 1:5 w/w.

In some preferred embodiments the ratio of the solid particulate material to the animal substrate to water can be from about 1:1:1 to about 50:50:1 w/w.

In some preferred embodiments the treatment chamber can have an ullage volume of at least 10% by volume. In some preferred embodiments the treatment chamber can have an ullage volume of at least 20% by volume, and more preferably from 30-60% or 30 to 70% by volume. These ullage volumes can be effective in order to provide for efficient mixing whilst maximising the utilisation capacity of the method.

In some preferred embodiments the method can comprise adding a first portion of the aqueous treatment formulation and agitating the moistened animal substrate with the treatment formulation in the sealed apparatus before introducing the solid particulate material.

In some preferred embodiments the method can comprise agitating the moistened animal substrate with the solid particulate material in the sealed apparatus before adding the aqueous treatment formulation.

In some preferred embodiments the method can comprise recirculating the solid particulate material into the treatment chamber via recirculation means. In particular embodiments, the apparatus can comprise a storage chamber for the solid particulate material and the method can comprise recirculating the particulate material between the storage chamber and the treatment chamber. The storage chamber can be in the form of a sump.

In some preferred embodiments the method can further comprise, before or after said agitating the moistened animal substrate with an aqueous treatment formulation and a solid particulate material, subjecting said animal substrate to at least one further treatment selected from tanning, retanning, cleaning, curing, beamhouse treatments including soaking, liming, unhairing, scudding, fleshing, deliming, bating, pickling and fat liquoring, enzyme treatment, dye fixing, and one or more additional colourant treatments.

In some preferred embodiments, the method can additionally comprise a step of cleaning the animal substrate.

In some preferred embodiments, the method can comprise cleaning the animal substrate before treating an animal substrate by applying a colourant thereto.

In some preferred embodiments the treatment formulation can comprise at least 5% w/w water.

In some preferred embodiments the treatment formulation can comprise not more than 99.9% w/w water.

In some preferred embodiments the treatment formulation can comprise water and substantially no organic solvent.

In some preferred embodiments the aqueous treatment formulation comprising at least one colourant can have a pH less than 7.

In some preferred embodiments the method can comprise a dye penetration stage and a subsequent dye fixing stage and the formulation comprising at least one colourant can have a pH less than 7 in the dye penetration stage and a pH less than 7 in the dye fixing stage.

In some preferred embodiments the method comprises a dye penetration stage and a subsequent dye fixing stage and the formulation comprising at least one colourant can have a pH less than 7 in the dye penetration stage and a pH greater than 7 in the dye fixing stage.

In some preferred embodiments the method can comprise no step configured to coat the solid particulate material with the colourant prior to contact of the particulate material with the animal substrate.

In some preferred embodiments uncoated, washed or cleaned solid particulate material can be introduced into the treatment chamber. Such uncoated, washed or cleaned solid particulate material can be introduced in the presence of said animal substrate.

In some preferred embodiments the method can comprise adding to said treatment chamber, simultaneously or sequentially, the animal substrate, aqueous treatment formulation comprising at least one colourant and solid particulate material having colourant on the surface thereof, said colourant on the solid particulate material surface being colourant remaining on said solid particulate material surface after an previous treatment of an animal substrate with said solid particulate material in the presence of an aqueous treatment formulation comprising said colourant.

In some preferred embodiments the particles can be re-used at least once in a subsequent treatment process according to the method. In an embodiment, the polymeric or non-polymeric particles may be reused one or more times. Typically, the polymeric or non-polymeric particles are reused in the methods of the present invention.

Typically the polymeric or non-polymeric particles can be reused at least 2, at least 10, at least 20, at least 50 or even at least 100 times. The particles are typically not reused more than 10,000 time. In some preferred embodiments the particles are not reused more than 1,000 times.

In some preferred embodiments the method can include the step of subjecting the particles to a cleaning procedure after the treatment of the animal substrate.

When the polymeric or non-polymeric particles are reused it is often desirable to intermittently clean the particles. This can be helpful in preventing unwanted contaminants from building up and/or in preventing treatment components from degrading and then depositing on the animal substrate. In some preferred embodiments, the particle cleaning step can be performed after every 10, after every 5, after every 3, after every 2 or after every 1 agitation step(s). The particle cleaning step can comprise washing the polymeric or non-polymeric particles with a cleaning formulation. The cleaning formulation can be a liquid medium such as water, an organic solvent or a mixture thereof. In some preferred embodiments, the cleaning formulation can comprise at least 10 wt %, more preferably at least 30 wt %, even more preferably at least 50 wt %, especially at least 80 wt % water, more especially at least 90 wt % water. The cleaning formulation can comprise one or more cleaning agents to aid the removal of any contaminants. Suitable cleaning agents can include surfactants, detergents, dye transfer agents, biocides, fungicides, builders and metal chelating agents. The particles can be cleaned at a temperature of from 0° C. to 40° C. for energy economy but for even better cleaning performance temperatures of from 41 to 100° C. can be used. The cleaning times can generally be from 1 second to 10 hours, typically from 10 seconds to 1 hour and more typically from 30 seconds to 30 minutes. The cleaning formulation can be acidic, neutral or basic depending on the pH which best provides for cleaning of the specific treatment formulation components. During cleaning it can be desirable that the polymeric or non-polymeric particles are agitated so as to speed up the cleaning process. In some preferred embodiments, the cleaning step for the solid particulate material can be performed in the absence of any animal substrate. In some preferred embodiments the method of the invention can performed in an apparatus fitted with an electronic controller unit which is programmed to cause the apparatus to perform the agitation step (cycle) and then intermittently the particle cleaning step (cycle). When a different treatment formulation is used and/or a different substrate it can be desirable to perform the particle cleaning step so as to prevent or reduce the potential for any cross contamination of chemicals or materials.

In some preferred embodiments the solid particulate material can be recovered from the treatment chamber after the treatment of the animal substrate.

In some preferred embodiments the solid particulate material does not penetrate the surface of the animal substrate.

In some preferred embodiments the solid particulate material can comprise a multiplicity of polymeric particles, or a multiplicity of non-polymeric particles, or a mixture of a multiplicity of polymeric and non-polymeric particles.

In some preferred embodiments the polymeric or non-polymeric particles can have an average density of about 0.5 $g/cm^3$ to about 20 $g/cm^3$.

In some preferred embodiments the polymeric or non-polymeric particles can have an average density of about 0.5 $g/cm^3$ to about 3.5 $g/cm^3$. In some embodiments polymeric particles having a density of 0.5 to 3.5 $g/cm^3$ can be particularly suitable. In other embodiments polymeric particles having a density of 0.5 to less than 1 $g/cm^3$ can be particularly suitable.

In some preferred embodiments the polymeric or non-polymeric particles can have an average mass of about 1 mg to about 5 kg. In some embodiments, the polymeric or non-polymeric particles can have an average mass of 1 mg to 500 g, in other embodiments 1 mg to 100 g and in further embodiments the polymeric or non-polymeric particles can have an average mass of 5 mg to 100 mg.

In some preferred embodiments the polymeric or non-polymeric particles can have an average particle diameter of from about 0.1 to about 500 mm.

In some preferred embodiments the polymeric or non-polymeric particles can have an average particle diameter of from about 1 mm to about 500 mm.

In some embodiments the polymeric or non-polymeric particles can have an average particle diameter of from 0.5 to 50 mm or from 0.5 to 25 mm or 0.5 to 15 mm or 0.5 to 10 mm or 0.5 to 6.0 mm, in other embodiments of from 1.0 to 5.0 mm and in further embodiments of from 2.5 to 4.5 mm. The effective average diameter can also be calculated from the average volume of a particle by simply assuming the particle is a sphere. The average is preferably a number average. The average is preferably performed on at least 10, more preferably at least 100 particles and especially at least 1000 particles.

In some preferred embodiments the polymeric or non-polymeric particles can have a length of from about 0.1 to about 500 mm.

In some preferred embodiments the polymeric or non-polymeric particles can have a length of from about 1 mm to about 500 mm.

In some embodiments the polymeric or non-polymeric particles can have a length of from 0.5 to 50 mm or from 0.5 to 25 mm, or from 0.5 to 15 mm or from 0.5 to 10 mm, or from 0.5 to 6.0 mm, in other embodiments of from 1.0 to 5.0 mm and in further embodiments of from 2.5 to 4.5 mm. The length can be defined as the maximum 2 dimensional length of each 3 dimensional polymeric or non-polymeric particle. The average is preferably a number average. The average is preferably performed on at least 10, more preferably at least 100 particles and especially at least 1000 particles.

In some preferred embodiments the polymeric particles can have an average volume of from about 5 to about 275 $mm^3$.

In some preferred embodiments the polymeric or non-polymeric particles can be solid, hollow or porous.

In some preferred embodiments the polymeric or non-polymeric particles can be chemically modified to include one or more moieties selected from the group consisting of: enzymes, oxidizing agents, catalysts, metals, reducing agents, chemical cross-linking agents and biocides.

In some preferred embodiments the polymeric or non-polymeric particles can comprise, or be in the form of, beads.

In some preferred embodiments the treatment formulation can comprise one or more components selected from the group consisting of: solvents, surfactants, cross-linking agents, preservation agents, metal complexes, corrosion inhibitors, complexing agents, biocides, builders, catalysts, chelating agents, dispersants, perfumes, optical brightening agents, enzymes, oils, waxes, waterproofing agents, flame retardants, stain repellants, reducing agents, acids, bases, neutralizing agents, polymers, resins, oxidising agents and bleaches.

In some preferred embodiments the polymeric particles can comprise particles of polyalkenes, polyamides, polyesters, polysiloxanes, polyurethanes or copolymers thereof.

In an embodiment, the polymeric particles can comprise particles of polyalkenes or polyurethanes, or copolymers thereof.

In an embodiment, the polymeric particles can comprise particles of polyamide or polyester or copolymers thereof.

In an embodiment, said polyamide particles can comprise particles of nylon.

In an embodiment, the polyamide particles can comprise Nylon 6 or Nylon 6,6.

In an embodiment, the polyester particles can comprise particles of polyethylene terephthalate or polybutylene terephthalate.

In an embodiment, the polymeric particles can comprise linear, branched or cross-linked polymers.

In an embodiment, the polymeric particles can comprise foamed or unfoamed polymers.

In some preferred embodiments the non-polymeric particles can comprise particles of ceramic material, refractory material, igneous, sedimentary or metamorphic minerals, composites, metal, glass or wood.

In some preferred embodiments the treatment formulation can comprise two or more portions and each portion of the treatment formulation can be the same or different.

In an embodiment, the treatment formulation can comprises at least a first portion for cleaning the animal substrate and at least a second portion for treating the animal substrate by applying a colourant thereto.

In some preferred embodiments, where the treatment formulation comprises two or more portions, each portion of the treatment formulation can added at a different time point during the treatment of the animal substrate.

In some preferred embodiments the treatment formulation can comprise at least one surfactant. In some embodiments, said surfactants can be selected from non-ionic, anionic, cationic surfactants, ampholytic, zwitterionic and semi-polar nonionic surfactants. In some embodiments, said at least one surfactant can be a non-ionic surfactant.

In some preferred embodiments the treatment formulation can comprise at least one preservation agent.

In some preferred embodiments the treatment formulation can comprise at least one tanning agent.

In some embodiments, said perfumes can be selected from alcohols, ketones, aldehydes, esters, ethers and nitrile alkenes, and mixtures thereof.

In some embodiments, said optical brightening agents can be selected from the group consisting of: stilbene derivatives, benzoxazoles, benzimidazoles, 1,3-diphenyl-2-pyrazolines, coumarins, 1,3,5-triazin-2-yls and naphthalimides.

In some embodiments, said enzymes can be selected from hemicellulases, peroxidases, proteases, carbonic anhydrases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, amylases and mixtures thereof.

In some embodiments, said oxidizing agents or bleaches can be selected from peroxygen compounds.

In some embodiments, said peroxygen compounds can be selected from the group consisting of: ozone, hydrogen peroxide, inorganic peroxy salts and organic peroxy acids.

In some preferred embodiments the method can further comprise a step of exposing the animal substrate to carbon dioxide.

In some preferred embodiments the method can further comprise a step of exposing the animal substrate to ozone.

In some preferred embodiments the method can consist of a treatment cycle comprising one or more phases or stages.

In some embodiments, the treatment formulation can comprises at least a first portion and a second portion wherein said first portion is added (to the treatment chamber) at a different phase or stage in the treatment cycle to the second portion of the treatment formulation.

In some preferred embodiments the method of the invention can be performed over a period of from 1 minute to 100 hours.

In some embodiments, each phase or stage in the treatment cycle of the method of the invention can be performed over a period of from 1 minute to 100 hours or 30 seconds to 10 hours.

In some preferred embodiments at least one phase or stage of the method can be carried out at a temperature of between about 0° C. and about 100° C.

In some embodiments, at least one phase or stage of the method can be carried out at a temperature of from about 20° C. to about 60° C.

In some embodiments, at least one phase or stage of the method can be carried out under pressure.

In some embodiments, at least one phase or stage of the method can be carried out under vacuum.

In some embodiments, at least one phase or stage of the method can be carried out under cooling.

In some embodiments, at least one phase or stage of the method can be carried out under heating.

In some embodiments, the method of treatment according to the present invention can include a step of milling the animal substrate.

In some embodiments, the method of treatment according to the present invention can include a step of conditioning the animal substrate.

In some embodiments, the method of treatment according to the present invention can include a step of drying the animal substrate.

In some preferred embodiments the method can comprise the steps of:

a) agitating the moistened animal substrate with a first portion of the aqueous treatment formulation and a solid particulate material in a sealed apparatus;
b) removing the solid particulate material;
c) adding a second portion of the aqueous treatment formulation and agitating the moistened animal substrate with the aqueous treatment formulation.

In some preferred embodiments the treatment chamber can comprise perforations.

In some preferred embodiments the sealed apparatus can comprise one or more dosing compartments suitable for containing one or more portions of the treatment formulation.

In some preferred embodiments the treatment formulation can comprise one or more portions and the sealed apparatus can be adapted to dispense the one or more portions of the treatment formulation at one or more predetermined time points.

In some preferred embodiments the method of this first aspect can comprise preparing an animal substrate for human use.

In some preferred embodiments the method can comprise one or more subsequent processing steps selected from drying, coating, lacquering, polishing, cutting, shaping, forming, embossing, punching, gluing, sewing, stapling and packaging the treated animal substrate or one or more parts thereof.

In some preferred embodiments the said one or more subsequent processing steps can comprise producing a finished leather substrate. A finished leather substrate can be a whole hide or a portion or part thereof.

A finished leather substrate as defined herein is a leather substrate to which no further processing step need be applied for changing its colour, physical or chemical structure or finish to render the leather suitable for producing a finished leather good. For the avoidance of doubt a finished leather substrate can be subject to subsequent processing steps including one or more of polishing, cutting, shaping, forming, embossing, punching, gluing, sewing, stapling and packaging for producing a finished leather good.

In some preferred embodiments the said one or more subsequent processing steps can comprise producing a finished leather good. The finished leather good can preferably be a leather good suitable for use by industries or manufactories other than, or suitable for distribution or sale through trade or retail channels subsequent to, the leather manufacturing (e.g. tanning and/or dyeing) industry. In embodiments of the invention a finished leather good can be produced from a finished leather substrate by one or more processing steps selected from drying, coating, lacquering, polishing, cutting, shaping, forming, embossing, punching, gluing, sewing, stapling and packaging of the finished leather substrate. The finished leather could can be made or wholly or in part from leather, in particular from a finished leather substrate.

Said finished leather good can be selected from one or more of: articles of apparel and personal accessories, footwear, bags, briefcases, satchels and suitcases, saddlery, furniture and upholstered articles, sporting goods and accessories, pet collars and leashes, and vehicle interior coverings.

Where said finished leather good is footwear, the finished leather good can be selected from one or more of shoes, boots, sports shoes, trainers, pumps, sneakers, sandals and the like.

Where said finished leather good is an article of apparel, the finished leather good can be selected from one or more of gloves, jackets, coats, hats, trousers, neckties, belts, straps, protective clothing (such as motorcycle leathers), and the like. Where said finished leather good is a personal accessory, the finished leather good can be selected from one or more of purses, wallets, spectacle cases, card cases, watchstraps, wristbands, protective covers for portable electronic devices, leather-bound books such as diaries and notebooks, and the like.

Where said finished leather good is an upholstered article, the finished leather good can be selected from one or more articles of furniture such as chairs and seats, tuffets, pouffes and hassocks, ottomans, stools, tables, desks (e.g. tables or desks having a leather covering), sofas, couches, divans, banquettes and bed heads. Where said finished leather good is a seat, the finished leather good can be a seat for a vehicle, such as a car seat or a train, bus, coach or aircraft seat.

Where said finished leather good is a vehicle interior covering, the finished leather good can be a covering for a fascia, dashboard, console, door capping or the like. The method of the invention can include shaping a finished leather substrate by forming, cutting or the like and applying the finished leather substrate to a supporting part of said vehicle interior.

Where said finished leather good is an article of saddlery, the finished leather good can be a saddle, harness, bridle, whip or the like or other tack, in particular for equine use.

According to a second aspect of the present invention there is provided an animal substrate obtained by the method of the above first aspect of the invention. The inventors believe that the mechanical action resulting from the agitation of the solid particulate with the animal substrate and the treatment formulation can yield an animal substrate with different or improved properties compared to those produced by methods of the prior art.

According to a third aspect of the present invention there is provided a finished leather good or a component of a finished leather good obtained by a method according the first aspect of the invention or comprising an animal substrate according the second aspect of the invention.

In some embodiments of this third aspect, the finished leather good can be as defined above in relation to the first aspect.

In the context of the present application, the term "method for treating an animal substrate" can refer to modifying or transforming the properties of a substrate immediately derived from an animal, in particular before the animal substrate is treated or processed to form a manufactured article. Notably, the method of the invention is distinguished from processes such as "laundering" wherein the substrate is typically a garment or fabric (being a manufactured article) and the properties of the substrate are not transformed after the process has been performed.

Advantageously, the method of the invention facilitates the use of only limited amounts of water thereby offering significant environmental benefits compared to standard processes commonly employed in this field. In fact, the method of the invention typically provides a water usage saving of at least 75% compared with the best water usage saving that can be achieved by the methods of the prior art. As the quantity of water used in the method of the invention can be significantly reduced, the amount of chemicals required in the treatment formulation in order to provide an effective treatment of the animal substrate can be decreased. Furthermore, a more uniform and increased mechanical action on the substrate resulting from the agitation with the solid particulate material can reduce the duration of the necessary treatment cycle providing improvements in efficiency over processes of the prior art.

BRIEF DESCRIPTION OF THE DRAWINGS

Embodiments of the invention are further described hereinafter with reference to the accompanying drawings, in which.

DETAILED DESCRIPTION

Figure 1:
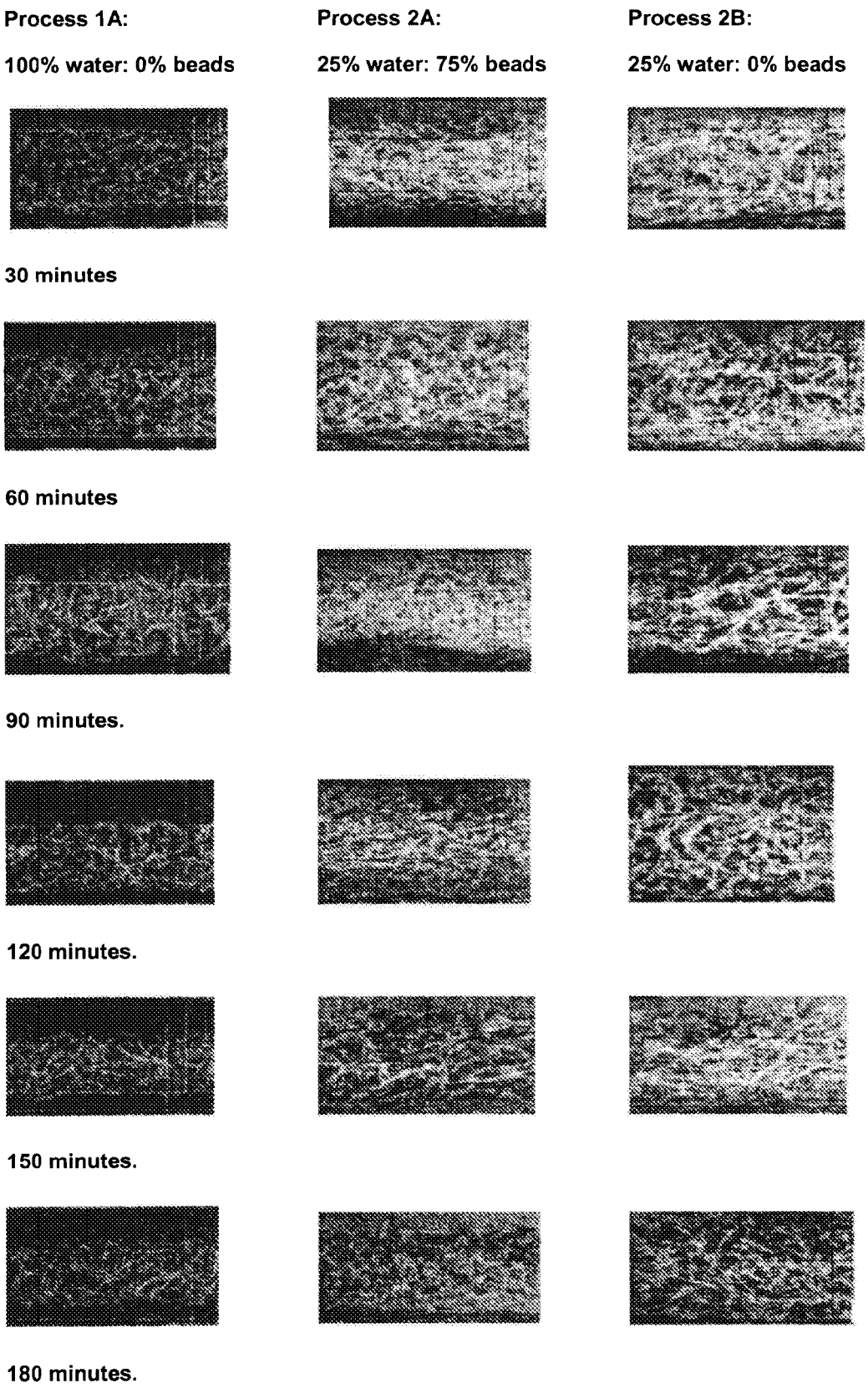
FIG. 1 is an image from a digital microscope showing cross sections of dyed leather samples from process 1A, 2A and 2B as described in Table 1 after periods of 30, 60, 90, 120, 150 and 180 minutes.

The method of the invention comprises agitating a moistened animal substrate with an aqueous treatment formulation and a solid particulate material in a sealed apparatus. The method of the invention relates to a treatment process for modifying or transforming the properties of a substrate immediately derived from an animal. Thus in some embodiments, the animal substrate may require one or more treatments before it is suitable for human use. Such treatments may thus be required before the animal substrate can be used for consumer, domestic and/or industrial purposes (for example, in clothing, upholstery or automotive industries).

The treatment method of the invention may comprise a cleaning step. In certain embodiments, the cleaning step can be performed prior to a chemical modification of the substrate. Cleaning may be necessary to remove any unwanted materials adhered to the exterior of the animal substrate. In some embodiments, a treatment formulation to be used in a cleaning step can comprise one or more enzymes. In certain embodiments, the treatment formulation can comprise proteolysis enzymes. In order to enhance cleaning of the animal substrate, in particular in a cleaning step, a treatment formulation can comprise one or more surfactants. In preferred embodiments, the treatment formulation, in particular in a cleaning step, can comprise non-ionic surfactants.

The treatment method of the invention can comprise one or more additional steps to remove further unwanted materials from the animal substrate. For example, the animal substrate may be subject to liming and deliming. In such embodiments, the treatment formulation can, at least for such additional steps, comprise reducing agents, bases, acids and/or neutralizing agents.

In other embodiments, the animal substrate may be subject to carbonizing in order to remove vegetable matter. In such embodiments, the treatment formulation can at least for such steps, comprise one or more surfactants, acids, neutralizing agents and bleaches. In a particular embodiment, the treatment formulation can comprise a non-ionic surfactant, sulphuric acid, sodium carbonate, hydrogen peroxide and formic acid.

The solid particulate material can comprise a multiplicity of polymeric or non-polymeric particles. Most preferably, the solid particulate material can comprise a multiplicity of polymeric particles. Alternatively, the solid particulate material can comprise a mixture of polymeric particles and non-polymeric particles. In other embodiments, the solid particulate material can comprise a multiplicity of non-polymeric particles. Thus the solid particulate material in embodiments of the invention can comprise exclusively polymeric particles, exclusively non-polymeric particles or mixtures of polymeric and non-polymeric particles in any desired relative amounts. Throughout this disclosure wherever a ratio is quoted with respect to polymeric and/or non-polymeric particles this will be understood as a reference to the sum total of polymeric and/or non-polymeric particles that may constitute the solid particulate material.

The polymeric or non-polymeric particles are of such a shape and size as to allow for good flowability and intimate contact with the animal substrate. A variety of shapes of particles can be used, such as cylindrical, spherical or cuboid; appropriate cross-sectional shapes can be employed including, for example, annular ring, dog-bone and circular. The particles may have smooth or irregular surface structures and can be of solid, porous or hollow construction. Non-polymeric particles comprising naturally occurring materials such as stone may have various shapes, dependent on their propensity to cleave in a variety of different ways during manufacture. Most preferably, however, said particles can comprise cylindrical, ellipsoidal, spheroidal or spherical beads.

The polymeric or non-polymeric particles can preferably be of such a size as to have an average mass in the region of 1 mg to 5 kg, preferably in the region of 1 mg to 500 g, more preferably from 1 mg to 100 g and most preferably 5 mg to 100 mg. In the case of the most preferred particles, typically referred to as beads, a preferred average particle diameter can be in the region of from 0.1 to 500 mm, 0.5 to 50 mm, 0.5 to 25 mm, 0.5 to 15 mm, 0.5 to 10 mm or preferably from 0.5 to 6.0 mm, more preferably from 1.0 to 5.0 mm, most preferably from 2.5 to 4.5 mm, and the length of the beads can preferably be in the range from 0.1 to 500 mm, more preferably from 0.5 to 50 mm, 0.5 to 25 mm, or from 0.5 to 15 mm or from 0.5 to 10 mm, even more preferably from 0.5 to 6.0 mm, more preferably from 1.5 to 4.5 mm, and is most preferably in the region of from 2.0 to 3.0 mm.

In some embodiments, the polymeric or non-polymeric particles can be partially or substantially dissolvable.

The polymeric or non-polymeric particles can be chemically modified to include additional moieties. Thus in some embodiments the particles can be chemically modified to further include one or more moieties selected from the group consisting of: enzymes, oxidizing agents, catalysts, metals, reducing agents, chemical cross-linking agents and biocides.

The polymeric particles can comprise polyalkenes such as polyethylene and polypropylene, polyamides, polyesters, polysiloxanes or polyurethanes. Furthermore, said polymers may be linear, branched or crosslinked. In certain embodiments, said polymeric particles can comprise polyamide or polyester particles, particularly particles of nylon, polyethylene terephthalate or polybutylene terephthalate, typically in the form of beads. Copolymers of the above-polymeric materials can also be employed for the purposes of the invention. The properties of the polymeric materials can be tailored to specific requirements by the inclusion of monomeric units which confer particular properties on the copolymer. Various nylon homo- or co-polymers can be used including, but not limited to, Nylon 6 and Nylon 6,6. In an embodiment, the nylon comprises Nylon 6,6 copolymer, preferably having a molecular weight in the region of from 5000 to 30000 Daltons, more preferably from 10000 to 20000 Daltons, most preferably from 15000 to 16000 Daltons. The polyester can typically have a molecular weight corresponding to an intrinsic viscosity measurement in the range of from 0.3 to 1.5 dl/g, as measured by a solution technique such as ASTM D-4603. In certain embodiments, said polymeric particles can comprise synthetic or natural rubber.

The polymeric or non-polymeric particles can be solid, porous or hollow. Furthermore, the polymeric or non-polymeric particles can be filled or unfilled. Where the polymeric or non-polymeric particles are filled, said particles can comprise, for example, additional moieties within the particle interior.

In some embodiments, the polymeric particles can have an average density of 0.5 to 3.5 g/cm$^3$ and an average volume of 5 to 275 mm$^3$.

In certain embodiments, the solid particulate material can comprises non-polymeric particles. In such embodiments, the non-polymeric particles can comprise particles of ceramic material, refractory material, igneous, sedimentary or metamorphic minerals, composites, metal, glass or wood. Suitable metals can include, but are not limited to, zinc, titanium, chromium, manganese, iron, cobalt, nickel, copper, tungsten, aluminium, tin and lead, and alloys thereof (such as steel). Suitable ceramics can include, but are not limited to, alumina, zirconia, tungsten carbide, silicon carbide and silicon nitride.

In some embodiments, the non-polymeric particles can have an average density of 0.5 to 20 g/cm$^3$, more preferably from 2 to 20 g/cm$^3$ and especially from 4 to 15 g/cm$^3$.

In order to provide lubrication for the treatment system, the animal substrate is moistened. This can be achieved by wetting the substrate with water and, most conveniently, the substrate can be wetted simply by contact with mains or tap water. The wetting of the substrate can be carried out so as to achieve a water to animal substrate ratio of between 1000:1 and 1:1000 w/w. Typically, the ratio of water to animal substrate can be from 1:100 to 1:1 w/w more typically from 1:50 to 1:2 w/w, especially typically from 1:40 to 1:2 w/w, more especially typically from 1:20 to 1:3 w/w and most typically from 1:15 to 1:5 w/w. In some embodiments, the ratio of water to animal substrate is at least 1:40 w/w, at least 1:30 w/w, at least 1:20 w/w or at least 1:15 w/w. In some embodiments, the ratio of water to animal substrate is no more than 10:1 w/w, no more than 5:1 w/w, no more than 2:1 w/w or no more than 1:1 w/w.

The treatment formulation of the invention can in some embodiments, comprise one or more components effective to modify the animal substrate in some way and optionally impart certain properties to the modified substrate. Thus the treatment formulation can in some embodiments contain ingredients which perform a cleaning function and ingredients that elicit other effects such as chemical modification of the substrate. The treatment formulation of the invention can comprise one or more components selected from the group consisting of: solvents, surfactants, cross-linking agents, preservation agents, metal complexes, corrosion inhibitors, complexing agents, biocides, builders, catalysts, chelating agents, dispersants, perfumes, enzymes, oils, waxes, waterproofing agents, flame retardants, stain repellants, reducing agents, acids, bases, neutralizing agents, polymers, resins, oxidising agents and bleaches.

Surfactants can be selected from non-ionic and/or anionic and/or cationic surfactants and/or ampholytic and/or zwitterionic and/or semi-polar nonionic surfactants.

In some embodiments, suitable builders can be included in the treatment formulation and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid and soluble salts thereof.

Optionally, the treatment formulation can also contain dispersants. Suitable water-soluble organic materials are the homo- or co-polymeric acids or their salts, in which the polycarboxylic acid may comprise at least two carboxyl radicals separated from each other by not more than two carbon atoms.

Optionally, the treatment formulation can also contain perfumes. Suitable perfumes can generally be multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1]benzofuran). One example of a commercially available fully formulated perfume is Amour Japonais supplied by Symrise® AG.

In some embodiments, the animal substrate can be include an optical brightening agent. Suitable optical brighteners which may be included in the treatment formulation fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl)thiophene.

The method of the invention can comprise a step wherein the animal substrate is agitated with a treatment formulation comprising one or more oils. The inclusion of one or more oils in the treatment formulation can impart specific properties to the substrate. In some embodiments, the treatment formulation can comprise oils with at least one sulphur moiety such as sulphated and/or sulphited oils to provide softness and flexibility to the animal substrate. In other embodiments, oils may be included to provide anti-static control, reduce friction and/or to improve lubrication.

Suitable acids which may be contained in the treatment formulation can include, but are not limited to, sulphuric acid, formic acid and ammonium salts. Suitable bases can include, but are not limited to, calcium hydroxide and sodium hydroxide. Suitable neutralizing agents include, but are not limited to, sodium carbonate and sodium bicarbonate.

Enzymes that may be used in the treatment formulation include, but are not limited to, hemicellulases, peroxidases, proteases, carbonic anhydrases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, amylases and mixtures thereof.

Dyes that may be used in the treatment formulation can include, but are not limited to, anionic, cationic, acidic, basic, amphoteric, reactive, direct, chrome-mordant, premetallised and sulphur dyes.

In some embodiments of the invention. the treatment formulation can include one or more bleaches and/or oxidizing agents. Examples of such bleaches and/or oxidizing agents can include, but are not limited to, ozone, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. The bleaches and/or oxidizing agents can be activated by a chemical activation agent. Activating agents can include, but are not limited to, carboxylic acid esters such as tetraacetylethylenediamine and sodium nonanoyloxybenzene sulphonate. Alternatively, the bleach compounds and/or oxidizing agents can be activated by heating the formulation.

In some embodiments, the treatment method of the invention may include one or more chemical modification steps in order to colour the substrate. Thus in such embodiments, the treatment formulation can include at least one colourant. The colourant can be selected from, for example, one or more dyes, pigments, optical brighteners or mixtures thereof. Dyes can be especially suitable as the colourant as dyes are believed to provide better penetration of the colourant into the structure of the animal substrate.

The solid particulate material can be substantially uncoated with one, several or all components of the treatment formulation (excluding of course water). In particular, prior to at least a first agitation step it is preferred that the solid particulate material is not coated with a colourant (e.g. a dye or a pigment). The treatment formulation and the solid particulate material can be premixed prior to the agitation step but this is preferably under conditions which do not promote or cause the colourant to coat the particles of the solid particulate material. So, for example, the colourant can be a dye which is soluble in the treatment formulation, e.g. having a solubility of greater than 1 g per liter, more preferably greater than 2 g per liter and especially greater than 5 g per liter of the treatment formulation, and/or additional organic solvents can be added to the water in the treatment formulation to promote solubility of the dye, and/or the solid particulate material can be chosen which specifically has no affinity with the dye. Suitable organic solvents can include water-miscible alcohols, glycols, amides and the like. When the colourant is insoluble or only partially soluble in the treatment formulation it is preferred that the colourant is dispersed with one or more dispersants. These can be cationic, anionic or non-ionic dispersants. In one embodiment coating of the solid particulate material is prevented or inhibited by having dispersants of the same type which stabilize both the solid particulate material and the colourant during the agitation step. For example both the colourant and the solid particulate material may be dispersed with an anionic dispersant, both may be dispersed with a cationic dispersant or both may be dispersed with a non-ionic dispersant. When dispersing the colourant it is preferably a pigment, an insoluble dye or a slightly soluble (<1 g liter) dye. When the colourant is dispersed or dissolved in the treatment formulation in the presence of the particulate solid this is preferably done below 30° C., more preferably below 25° C. Using lower temperatures tends to reduce the possibility for coating the solid particulate material.

The colourant can be dispersed or dissolved in the treatment formulation. In some embodiments the colourant can be dispersed or dissolved in the treatment formulation in the absence of the solid particulate material. This can help to prevent any possibility that the colourant pre-coats the solid particulate material. The solid particulate material can then be added prior to or during agitation. Alternatively, the colourant can be dispersed or dissolved in an aqueous liquid medium (again in the absence of the solid particulate material) and then added to the treatment formulation.

In some preferred embodiments, a mixture of the treatment formulation containing a colourant and the solid particulate material is such that substantially no coating of the solid particulate material results and the colourant does not penetrate into the solid particulate material. In one embodiment this can be determined by: i. adding 100 g of solid particulate material to 100 g of water containing 2 wt % of colourant; ii. stirring the mixture for 1 hour at 25° C.; iii. removing the solid particulate material from the water by means of filtration; iv. measuring the amount of colourant remaining in the water (e.g. by colourimetic, UV, refractive index or gravimetric analysis); and v. calculating the amount of colourant which has not coated or penetrated the solid particulate material. Preferably, this value should mean that greater than 90 wt %, more preferably greater than 95 wt %, especially greater than 98 wt % and more especially greater than 99 wt % of the colourant remains in the water. Preferably, the water is at pH 7.

In some embodiments the aqueous treatment formulation comprises a colourant and the method comprises applying the colourant to the animal substrate wherein at least some of the colourant so applied originates from the treatment formulation. Typically, at least some, more typically essentially all of the colourant so applied was, prior to application, physically separate from the solid particulate material. Preferably, at least 50 wt %, more preferably at least 70 wt %, especially at least 90 wt %, more especially at least 99 wt % and most especially essentially all the colourant which is applied to the animal substrate originates from the treatment formulation (and not from the surface or interior of the solid particulate material). Preferably, during the method which comprising applying a colourant to the animal substrate there is no measurable net loss of colourant from the solid particulate material. This shows that essentially all of the colour applied to the animal substrate originates from the treatment formulation. Typically, the amount of colourant in or coating the particulate solid will remain constant or may just slightly rise during the agitation process.

The treatment formulation may have a basic (>7), and acidic (<7) or neutral (7) pH. In many embodiments it is desirable that the pH of the treatment formulation is acidic. The acidic pH is typically less than 6.9, more typically less than 6.5, even more typically less than 6 and most typically less than 5.5. The acidic pH is typically no less than 1, more typically no less than 2 and most typically no less than 3. The pH or the treatment formulation can differ at different times, points or stages in the treatment process according to embodiments of the invention. Preferably, the treatment formulation has the above typical pH value for at least some time during the agitation.

In some embodiments of the invention, before or after said agitating the moistened animal substrate with an aqueous treatment formulation and a solid particulate material, the methods of the present invention can include any one or more of the following additional steps used in the production of leather: curing, beam house operations, fatliquoring, scudding, preserving, soaking, liming, deliming, unhairing, fleshing, splitting, reliming, bating, degreasing, frizzing, bleaching, pickling, depickling, pretanning, tanning, retanning, tawing, crusting, coating, colouring (dyeing) and finishing.

In certain embodiments, the treatment method of the invention can include one or more additional chemical modification steps in order to preserve the substrate. In some embodiments, wherein the animal substrate is a hide, the substrate can be subjected to tanning. In such embodiments the treatment formulation can comprise one or more preservation (especially tanning) agents. Suitable preservation (especially tanning) agents can include, but are not limited to, chromium salts, glutaraldehyde and natural polyphenol tannins.

In further embodiments, the treatment method of the invention can include one or more further chemical modification steps to tailor the specific properties of the animal substrate. Thus in some embodiments, the treatment formulation may include one or more tanning agents which can be synthetic tanning agents. Suitable synthetic tanning agents can include, but are not limited to amino resins, polyacrylates, fluoro and/or silicone polymers and formaldehyde condensation polymers based on phenol, urea, melamine, naphthalene, sulphone, cresol, bisphenol A, naphthol and/or biphenyl ether.

The tanning agents can be vegetable tanning agents. Vegetable tanning agents comprise tannins which are typically polyphenols. Vegetable tanning agents can be obtained from plant leaves, roots and especially tree barks. Examples of vegetable tanning agents include the extracts of the tree barks from chestnut, oak, redoul, tanoak, hemlock, quebracho, mangrove, wattle acacia; and myrobalan. The tanning agents can be mineral tanning agents. Some particularly suitable mineral tanning agents comprise chromium compounds, especially chromium salts and complexes. The chromium is preferably in a chromium (III) oxidation state. A preferred chromium (III) tanning agent is chromium (III) sulphate. Other tanning agents can include aldehydes (glyoxal, glutaraldehyde and formaldehyde), oxazolidine, phosphonium salts, metal compounds other than chromium (e.g. iron, titanium, zircomium and alumunium compounds). The treatment formulation, especially for tanning, can be acidic, neutral or basic. Vegetable and chromium tanning agents are preferably used with acidic treatment formulations.

The treatment formulation preferably comprises sulfuric, hydrochloric, formic or oxalic acid when acidic formulation are to be used.

In some embodiments the water in the treatment formulation has been softened or demineralized.

For colouring a hide or a skin according to embodiments of the invention, the method can be performed during or after tanning using a treatment formulation which comprises a colourant. In one embodiment a hide or skin can first be tanned e.g. using chromium to provide a "wet blue" product. This tanned (e.g. wet blue) product can then be used as the substrate in the methods of the present invention wherein at least one of the components of the treatment formulation is a colourant. Performing the colouration in this way has been found to produce animal hides and skins with especially good colour shade, intensity, colour uniformity and substantivity of colouration.

In certain embodiments, the treatment formulation can include one or more waterproofing agents. Examples of suitable waterproofing agents are hydrophobic silicones. In further embodiments, the treatment formulation can include one or more flame retardants. Suitable flame retardants include, but are not limited to, titanium hexfluoride or zirconium hexafluoride. In particular embodiments, the treatment formulation can include one or more stain repellants. Suitable stain repellants include, but are not limited to, polysulphones, waxes, salts, silicone polymers and polytetrafluoroethylene (PTFE).

As the method of the invention can be used with significantly less water than methods of the prior art, in embodiments of the invention the quantity of chemicals or chemical loading in the treatment formulation can be reduced.

The treatment formulation comprises water. In embodiments wherein the solid particulate material comprises polymeric and/or non-polymeric particles, the ratio of water to polymeric and/or non-polymeric particles is in the region of from 1000:1 to 1:1000 w/w. In some preferred embodiments, the ratio of treatment formulation to polymeric and/or non-polymeric particles is from 10:1 to 1:100 w/w, more preferably from 1:1 to 1:100 w/w, even more preferably from 1:2 to 1:100 w/w, yet more preferably from 1:5 to 1:50 w/w and especially from 1:10 to 1:20 w/w.

In some embodiments the ratio of polymeric and/or non-polymeric particles to substrate can be from 1000:1 to 1:1000 w/w, more preferably from 10:1 to 1:10 w/w, especially from 5:1 to 1:5 w/w, more especially from 4:1 to 1:2 w/w and most especially from 2:1 to 1:1 w/w.

In some embodiments the treatment formulation can comprise water alone or it can comprise water and one or more organic solvents. In certain embodiments the organic solvents are water-miscible. Preferred organic solvents can include alcohols, glycols and amides. In certain embodiments, the treatment formulation can comprise at least 10 wt %, more preferably at least 50 wt %, especially at least 80 wt %, more especially at least 90 wt % and most especially at least 95 wt % of water. In some embodiments no organic solvents are present in the treatment formulation other than trace amounts from impurities in other components of the treatment formulation.

As the treatment formulation can comprise multiple components, portions of the formulation may be added at different time points during a typical treatment cycle for the method of the invention. In this context, the term "treatment cycle" refers to the total duration required to modify or transform the animal substrate and may comprise one or more phases or stages. For example, a first portion of the treatment formulation may be added to the animal substrate before the addition of the solid particulate material. Thus the animal substrate may be agitated with the treatment formulation alone in the sealed apparatus prior to agitation with the treatment formulation and the solid particulate material as a first phase of the treatment process. A second portion of the treatment formulation may be added at a different time point in the treatment cycle. In certain embodiments, the solid particulate material may be removed before adding the second portion of the treatment formulation. Following the removal of the particulate material and the addition of the second portion of the treatment formulation, a second phase of the treatment process can be commenced with further agitation of the animal substrate with the treatment formulation. The respective first and second treatment formulation portions can comprise the same or different components. Furthermore, the treatment formulation can be divided into multiple portions wherein each portion comprises the same or different components. A series of treatment phases or stages can thus be conducted over the duration of the treatment cycle wherein the treatment formulation can be kept constant or varied for each respective phase.

In some embodiments, the treatment cycle of the invention can comprise a cleaning step and a chemical modification step. In such embodiments, the treatment formulation can comprise a first portion with one or more components for cleaning the substrate and a second portion with one or more components for chemically modifying the substrate. The respective first and second portions can be added at different time points during the treatment cycle. Hence the treatment cycle can consist of cleaning phase and a chemical modification phase wherein the addition of the first portion of the treatment formulation instigates the cleaning phase and the addition of the second portion of the treatment formulation instigates the chemical modification phase. In other embodiments, the cleaning and chemical modification of the substrate can occur simultaneously.

In certain embodiments, the treatment formulation can comprises a first portion and a second portion wherein the first portion is substantially free from enzymes and the second portion comprises enzymes. In such embodiments, the first portion of the treatment formulation can be added at a first phase in the treatment cycle and the second portion of the treatment formulation can be added at a second phase in the treatment cycle.

In some embodiments, the solid particulate material can be retained throughout the treatment cycle as portions of the treatment formulation are added as outlined above. In other embodiments, the solid particulate material can be replaced prior to the addition of a further portion of the treatment formulation. This can be necessary to ensure that the animal substrate is not adversely affected by interactions occurring between incompatible chemical moieties. For example, chemical moieties which could potentially adhere to the solid particulate material following the introduction of one portion of the treatment formulation may not be compatible with chemical moieties present in a subsequent portion of the treatment formulation thus necessitating replacement of the solid particulate material before continuing the treatment cycle.

At one or more stages of the treatment cycle of the invention, the animal substrate can be subjected to heating or cooling. Furthermore, the animal substrate can be placed under conditions of vacuum or pressure. Furthermore, the animal substrate may be subjected to milling, conditioning or drying.

In certain embodiments, the method of the invention can comprise exposing the animal substrate to one or more agents during the treatment cycle in addition to the treatment formulation. Exposure to said one or more agents may be performed as the moistened animal substrate is agitated with the treatment formulation or in a separate step during the treatment cycle when the treatment formulation is not present. In such embodiments, the one or more agents can be gaseous. Exposure of the animal substrate to the gaseous agents can occur by introduction of said agents into the sealed apparatus at one or points during the treatment cycle. In some embodiments the gaseous agents can be carbon dioxide and/or ozone.

The duration of the treatment cycle can be any period from 1 minute to 100 hours and in other embodiments the duration of the treatment cycle can be from 1 minute to 48 hours. In embodiments wherein the treatment cycle comprises more than one phase, each respective phase of the treatment cycle can be any period of 30 seconds or greater or 1 minute or greater wherein the sum of the respective phases comprises the total duration of the treatment cycle. In certain embodiments each respective phase of the treatment cycle can be a period of from 30 seconds to 10 hours. The method of the invention can facilitate a considerable reduction in the duration of a typical treatment cycle as the presence of the solid particulate material can enhance the degree of mechanical action performed on the animal substrate. Thus the duration of each phase of the process can be reduced leading to a typical reduction of 20 to 50% of the total duration of the treatment cycle when compared to the methods employed in the prior art. In some embodiments, the mechanical action performed on the animal substrate by virtue of agitation with the solid particulate material is never sufficient to break up the animal substrate.

One or more phases of the method of the invention can be performed at a temperature of from 0 to 100° C. Furthermore, the method can include one or more heating or cooling steps. Thus the temperature can be raised or lowered between the values of 0 and 100° C. at one or more points throughout the treatment cycle. In some embodiments one or more phases of the method can be performed at a temperature of from 0 to 60° C. such as from 20 to 60° C. and in other embodiments at a temperature of from 30 to 50° C. As the method of the invention can lead to a reduction in the duration of the treatment cycle, it is possible for the method to be operated effectively at lower temperatures. For example, in one or more phases of the treatment cycle the method of the invention can effectively be performed at ambient temperature as opposed to higher temperatures which are generally required in the processes of the prior art. Also, because smaller amounts of treatment formulation can be used the amount of energy required to obtain these temperatures can be substantially reduced.

The method of the invention can comprise a batchwise or a continuous process. Alternatively, the method of the invention can comprise a combination of batchwise and continuous processes.

The method of the invention need not be conducted in the same sealed apparatus. Hence one phase or stage of the treatment can be carried out in one sealed apparatus and further phases or stages of the treatment can be carried out in different sealed apparatus. Thus the animal substrate can be transferred from one sealed apparatus to another in order to continue or complete the treatment. The method of the invention can include phases or stages where additional processing is carried out in unsealed apparatus. Such additional processing can include, for example, certain beamhouse operations. The method of the invention can include a phase or stage where separation of polymer or non-polymer particles in carried out in additional sealed or unsealed apparatus.

In embodiments of the invention wherein the solid particulate material comprises polymeric and/or non-polymeric particles, said particles can be treated or reacted with additional compounds or materials. In some embodiments, said particles may be treated with surfactants. In certain embodiments, said particles may be treated with one or more compounds selected from the group consisting of: sodium and potassium hydroxides, hypochlorates, hypochlorites, hydrogen peroxide, inorganic peroxy salts and organic peroxy acids.

The method of the invention can be carried out in an apparatus which is sufficiently large so as to accommodate the animal substrate to be treated and the treatment formulation, whilst still providing sufficient ullage to allow for efficient circulation and mixing of the materials when agitated during the treatment process. Typically, allowance should be made for ullage values of at least 10% by volume, preferably at least 20% by volume, more preferably from 30-60% by volume or from 30 to 70% by volume in order to provide for efficient mixing whilst maximising the utilisation capacity of the method.

The sealed apparatus for treating the animal substrate can comprise a treatment chamber and optionally one or more dosing compartments wherein each respective dosing compartment can contain at least one portion of the treatment formulation. The one or more dosing compartments can be adapted to dispense one or more portions of the treatment formulation at one or more predetermined time points in the treatment cycle.

The sealed apparatus for performing the method of the invention can be a device adapted for mechanical rotation. The sealed apparatus can include a treatment chamber which serves to contain the animal substrate and the treatment formulation during agitation. In certain embodiments, the treatment chamber can comprise a rotating drum or a rotatably mounted cylindrical cage. The sealed apparatus can comprise a housing means within which the drum or cage is mounted. Typically, the drum or cage can include an aperture or means to allow for the ingress or egress of the aqueous treatment formulation whilst ensuring the animal substrate remains within the confines of the drum or cage. In certain embodiments, the drum or cage can comprise perforations. The perforations may be sufficiently sized to allow for the entry and exit of the solid particulate material.

The sealed apparatus can further comprise at least one circulation means to enable circulation of the treatment formulation. For example, the apparatus can include ducting and pumping means to allow for the exit and re-entry of the treatment formulation in the treatment chamber. Furthermore, the sealed apparatus can additionally comprise at least one recirculation means to facilitate recirculation of the solid particulate material enabling re-use of the solid particulate material throughout the duration of the treatment cycle. For example, the sealed apparatus can include ducting and pumping means to facilitate the entry and exit of the particulate material from the treatment chamber.

In operation, during a typical treatment cycle comprising one or more phases, the moistened animal substrate can be first placed within the treatment chamber of the sealed apparatus. The aqueous treatment formulation and solid particulate material can then be introduced to the treatment chamber. Rotation of the treatment chamber ensures agitation of the animal substrate with the treatment formulation and the solid particulate material. In certain embodiments during the course of agitation by rotation of the treatment chamber, the fluids pass through an aperture or perforations in the treatment chamber and are returned to the treatment chamber via circulation means. The process of continuous circulation can proceed until the phase in the treatment cycle is completed. In other embodiments, agitation of the animal substrate in the treatment chamber with the treatment formulation can occur without continuous circulation of fluids such that fluids are only permitted to exit the treatment chamber when the phase in the treatment cycle is complete.

In further embodiments, the sealed apparatus can include means to facilitate the easy removal of the solid particulate material after the end of a phase in the treatment cycle or after completion of the treatment cycle. In certain embodiments wherein the treatment chamber includes sufficiently sized perforations, a quantity of the solid particulate material can pass through the perforations along with the fluids. Optionally, the solid particulate material can also be recirculated back into the treatment chamber via recirculation means. In certain embodiments, the treatment chamber can include a vacuum, a blower, a magnet or other appropriate apparatus to facilitate solid particle removal.

The sealed apparatus can be adapted for the subsequent re-use of the solid particulate material and also its storage within the apparatus prior to re-use. In certain embodiments, the solid particulate material can be removed from the sealed apparatus and cleaned before its re-use in an additional phase in the treatment cycle. In further embodiments, the solid particulate material can be replaced before commencing an additional phase in the treatment cycle.

In some embodiments, the animal substrate can comprise a hide, pelt or skin. In some embodiments, the animal substrate can be leather.

The invention will now be further illustrated, though without in any way limiting the scope thereof, by reference to the following examples and associated illustrations.

EXAMPLES

Quantities referred to in the treatment process or for the process medium (which, in some instances, pertains to the treatment formulation) as used herein and throughout the examples are commonly expressed using one or more terms such as float (e.g. dye float), ratios, percentages, w/w (or % w/w) and charges. Unless the context indicates otherwise, these values refer to the quantity of one or more components ("X") in relation to the weight or quantity of the substrate. By means of illustration, expressions such as 100 w/w X, 100% of X and 1:1 substrate:X and the like indicates that the same quantity of X is used as the substrate quantity. Likewise, a 100% "charge" of X or a 100% float of X and the like indicates that the same quantity of X is used as the substrate quantity. Furthermore expressions such as 50 w/w of X, 50% of X and 1:0.5 substrate:X and the like indicates that the quantity of X used is 50% of the substrate quantity. In addition, a 50% "charge" of X or a 50% float of X indicates that the quantity of X used is 50% of the substrate quantity. Moreover, expressions such as 150 w/w X, 150% of X and 1:1.5 substrate:X and the like indicates that the amount of X used is 150% of the substrate quantity. Likewise, a 150% "charge" of X or a 150% float of X and the like indicates that the quantity of X used is 150% of the substrate quantity. Furthermore, the term "float" can be construed to mean the amount or quantity of water used (which may optionally include one or more organic solvents) excluding any further auxiliaries such as dyes, surfactants or any supplementary chemicals for example.

Example 1—Dyeing of Hides

Treatment trials were carried out using a set of trial and control conditions (see Table 1). Thus, the trials involved the use of a preferred treatment apparatus, performed according to the method of the invention whilst the control was carried out in the same apparatus but without the presence of the solid particulate material. Four pairs of matched-side samples (20 cm×45 cm) of chrome-tanned hide were cut out from a whole wet-blue hide that tanned with 6% basic chromium sulphate (33% basicity, 25% $Cr_2O_3$). Marked samples were neutralized together to pH 6.1 in 100% water using sodium formate and sodium bicarbonate, 0.2% of dispersing agent (Invaderm LU, TFL Ledertechnik GmbH, Weil Am Rhein, Germany) was also added to avoid aggregation in the subsequent dyeing processes. The weight of each leather sample (wet, but without excess water) was measured and used for calculating the total volume of dyeing float and the quantity of dye. Dyeing trials were carried out over 3 hours using a cobalt-premetallised dye (2.0% w/w Sellaset yellow H, TFL Ledertechnik GmbH, Weil Am Rhein, Germany) at 45° C. and 8 rpm with a total float volume of 100% on the weight of the wet leather. Matched side trials were concurrently carried out using identical process drums (DOSE-drums, 50 cm radius and 25 cm width) that are fitted with a computerized control unit. Polymeric particles in the form of polyethylene terephthalate beads (PET beads) were used in the dyeing floats of the various trials along with water in the following proportions. Leathers dyed with process 1-4A were the trial samples and the comparative-controls were samples dyed without beads but only with 100%, 75%, 50% and 25% of water (process 1-4B). In all trials small pieces (3 cm×3 cm) of partly dyed leather were cut out every 30 minutes instantly frozen with liquid nitrogen, freeze-dried and analysed using a digital microscope.

TABLE 1

Matched Sides Trials At Various Bead & Water Ratios

| | Trials (matched sides) | Beads % age | Water % age |
|---|---|---|---|
| 1 | Process 1A | 0 | 100 |
| 2 | Process 2A | 75 | 25 |
| | Process 2B | 0 | 25 |

TABLE 1-continued

| Matched Sides Trials At Various Bead & Water Ratios | | | |
|---|---|---|---|
| Trials (matched sides) | | Beads % age | Water % age |
| 3 | Process 3A | 50 | 50 |
| | Process 3B | 0 | 50 |
| 4 | Process 4A | 25 | 75 |
| | Process 4B | 0 | 75 |

The dimensions of fully dyed parts of the cross-section were measured and the average of triplicated measurements were used to calculate the degree of dye penetration as shown in Table 2 below. The dye penetration rate (measured as percentage of dye penetration) was considerably greater for each and every measured time point for samples containing beads compared to control samples without beads (see experiment 2A versus experiment 2B and 1B). The dye penetration was measured using high resolution digital microscopy by determining the dye penetration distance through the sample cross section (in microns). The percentage dye penetration as shown in Table 2 can thus be expressed as 100× (dimension of dyed part of the cross-section/thickness of the sample substrate).

TABLE 2

| Dye Penetration Rate at Various Bead & Water Ratios | | | |
|---|---|---|---|
| Experiment 2A (75% Beads:25% Water) (% Dye Penetration) | Experiment 2B (25% Water) (% Dye Penetration) | Experiment 1A (100% Water) (% Dye Penetration) | Dye Penetration Time (minutes) (% Dye Penetration) |
| 52.9 | 37.6 | 31.8 | 30 |
| 59.5 | 47.8 | 41.5 | 60 |
| 64.9 | 54.2 | 52.9 | 90 |
| 73.9 | 63.9 | 61.8 | 120 |
| 79.2 | 66.6 | 63.6 | 150 |
| 80.7 | 67.6 | 64.7 | 180 |

Figure 2:
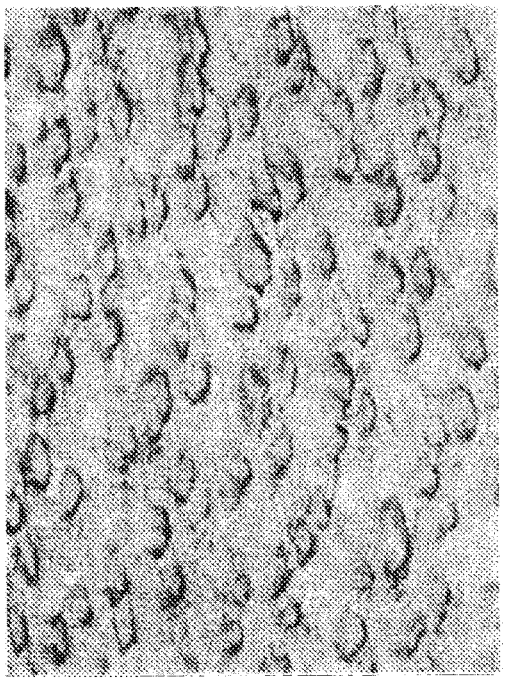
FIGS. 2A), B) and C) is an image from a digital microscope at 35× magnification showing a comparison of the surface characteristics of dyed leather samples from process 1A and process 4A, 3A and 2A as described in Table 1.
Figure 2:
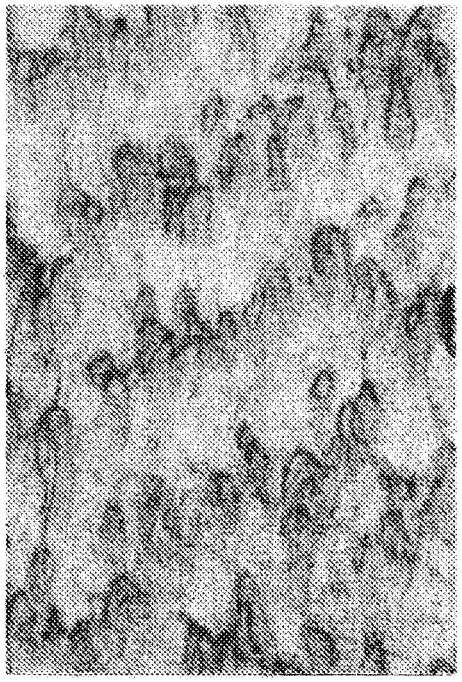
Figure 2:
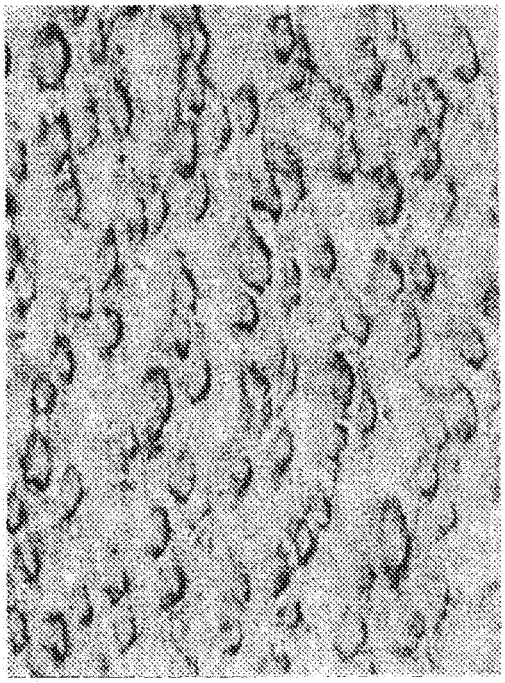
Figure 2:
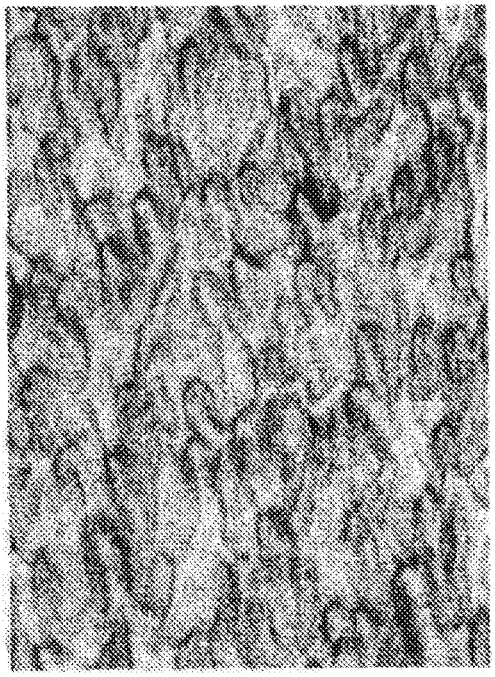
Figure 2:
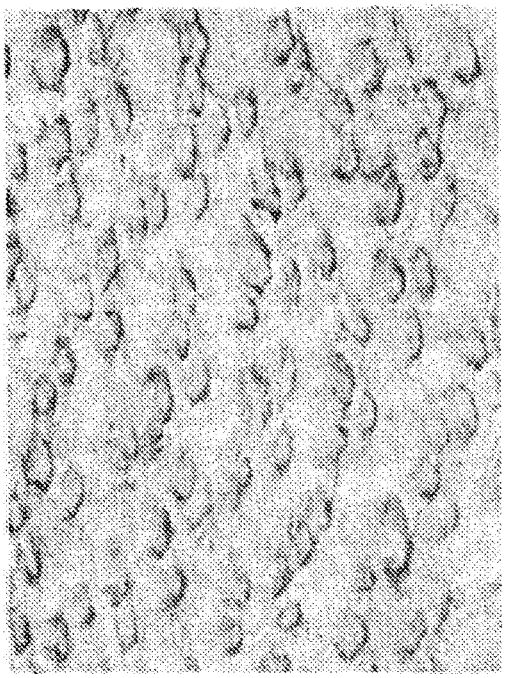
Figure 2:
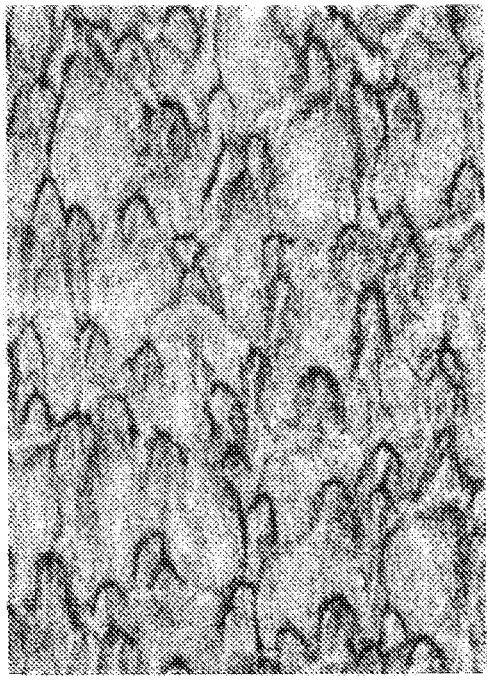

With reference to the accompanying drawings in FIGS. 1 and 2, when 75% of the water charge was replaced by PET beads, the experiments containing beads (FIG. 1 and FIG. 2, Process 2A) gave overwhelmingly faster, deeper and more uniform dye penetration compared to the controls without beads (FIG. 1, Process 1A and 2B and FIG. 2, Process 1A). Surprisingly, the PET beads also increased the colour shade intensity in the substrate.

Surprisingly, the surface uniformity and aesthetics were dramatically improved compared to the control. This resulted in a significantly more uniform surface structure, dyeing uniformity, and smoother surface texture. In FIG. 2, the control sample (Process 1A) showed considerable variation in surface texture and dyeing was non-uniform. Surprisingly, when 25%, 50% and 75% of the water was replaced by PET beads (Process 4A, 3A and 2A) the surface texture appeared significantly smoother with dramatically improved dye uniformity. Thus animal substrates produced by the methods of the invention exhibit an enhanced uniformity of colour, a smoother surface structure and softer texture compared to those produced by methods of the prior art.

Example 2—Dyeing of Hides Using Alternative Dye Compositions

Further dyeing experiments were conducted using Trupocor Red 2B, Trupocor Red EN and Trupocor Brown GST. These dyes cover a range of solubility, reactivity and penetration characteristics and therefore served as useful model systems for comparing the performance of the bead containing process against conventional and low water control processes. A comparison of the dyes is shown in the following table.

Table Comparing Performance Attributes of Trupocor Red 2B, Trupocor Red EN and Trupocor Brown GST Dyes:

| Performance Characteristic | Trupocor Red 2B | Trupocor Red EN | Trupocor Brown GST |
|---|---|---|---|
| Relative Penetration Rate (1-5 Scale, 1 is lowest, 5 is highest) | 4 | 3 | 3-4 |
| Solubility At 60° C. (IUF 201) | 100 | 30 | 30 |
| Migration Into PVC (IUF 442) | 4-5 | 3 | 3-4 |

Experiments were conducted on bovine crust leathers that were retanned and fat liquored and subjected to a dyeing process. The dyeing of leather during the post tanning stage is almost universal for shoe, garment, upholstery and automotive applications. The general fat liquoring, retanning and dyeing processes were conducted as described below and with reference to Table 3 and Table 4. The retanning and dyeing process described in Table 3 and Table 4 is comparable to that conducted for the preparation of automotive leathers such as those used for car upholstery.

TABLE 3

Retanning and dyeing process without beads:
Material: bovine wet blue
wet blue weight (kg): 10.50
% refer to shaved weight
Substance: 1.4 ± 0.1

| Process | | % | Products | dilution | min. | temp | pH |
|---|---|---|---|---|---|---|---|
| Control process | + | 150 | Water | | | 40 | |
| Neutralisation | + | 2 | Sodium formate | 1.3 | 10 | 40 | |
| | | 1.5 | Sodium bicarbonate | 1.3 | 10 | | |
| | + | 2 | Tanigan PAK | 1.3 | 30 | | 6.0 ± 0.2 |
| retannage | + | 3 | Trupotan RKM | 1:3 | 10 | | |
| | + | 3 | Tanigan OS | 1:3 | 10 | | |
| | | 3 | Mimosa WS | 1:3 | 30 | | 6.0 ± 0.1 |
| Dyeing | | 0.5 | Invaderm LU | 1:3 | 10 | 50 | |
| | | 2 | Trupocor dye | | 60 | | |
| Fatliquoring | + | 4 | Truposol LEX | 1:3 | | 50 | |
| | + | 5 | Truposol AWL | 1:3 | 60 | | |
| fixing | + | 0.5 | formic acid | 1:10 | 15 | | |
| | + | 0.5 | formic acid | 1:10 | 15 | | 4.0 ± 0.2 (chk) |
| Drain | | | | | | | |
| Wash (Control) | | 200 | water | | 5 | 40 | |

Chemicals used:

Sodium formate, Sodium bicarbonate and formic acid (VWR international Ltd. Lutterworth, UK); Tanigan PAK (neutralising syntan) and Tanigan OS (replacement syntan) from Lanxess Gmbh. Leverkussen, Germany); Mimosa WS (modified vegetable tannin, SilvaTeam Spa., Piedmont, Italy); Truposol LEX and Truposol AWL (Trumpler Gmbh., Worms, Germany); Invaderm LU (TFL Ledertechnik GmbH, Weil Am Rhein, Germany).

TABLE 4

Retanning and dyeing process using PET beads:
Material: bovine wet blue
wet blue weight (kg): 10.50
% refer to shaved weight
Thickness (mm): 1.4 ± 0.1

| Process | | % | Products | dilu-tion | min. | temp | pH | Remarks |
|---|---|---|---|---|---|---|---|---|
| Low water | + | 10 | Water | | | 40 | | substrate:water:bead = 10:1:14 |
| with PET | + | 140 | Teknor Apex beads | | | | | |
| Neutralisation | + | 2 | Sodium formate | 1.3 | 10 | 40 | | |
| | | 1.5 | Sodium bicarbonate | 1.3 | 10 | | | |
| | + | 2 | Tanigan PAK | 1.3 | 30 | | 6.0 ± 0.2 | |
| retannage | + | 3 | Trupotan RKM | 1:3 | 10 | | | |
| | + | 3 | Tanigan OS | 1:3 | 10 | | | |
| | | 3 | Mimosa WS | 1:3 | 30 | | 6.0 ± 0.1 | |
| Dyeing | | 0.5 | Invaderm LU | 1:3 | 10 | 50 | | |
| | | 2 | Trupocor dye | | 60 | | | |
| Fatliquoring | + | 4 | Truposol LEX | 1:3 | | 50 | | |
| | + | 5 | Truposol AWL | 1:3 | 60 | | | |
| fixing | + | 0.5 | formic acid | 1:10 | 15 | | | |
| | + | 0.5 | formic acid | 1:10 | 15 | | 4.0 ± 0.2 | |
| Drain | | | | | | | | sample collected for analysis |
| Wash | | 50 | water | | 5 | 40 | | |

Chemicals used:

Sodium formate, Sodium bicarbonate and formic acid (VWR international Ltd. Lutterworth, UK); Tanigan PAK (neutralising syntan) and Tanigan OS (replacement syntan) from Lanxess Gmbh. Leverkussen, Germany); Mimosa WS (modified vegetable tannin, SilvaTeam Spa., Piedmont, Italy); Truposol LEX and Truposol AWL (Trumpler Gmbh., Worms, Germany); Invaderm LU (TFL Ledertechnik GmbH, Weil Am Rhein, Germany).

Example 2A—Dyeing with Trupocor Red 2B

In order to prepare undyed crust leathers, wet-blue hides (thickness 1.8 mm) were retanned and fat liquored according to the process described in Table 3 and Table 4 above.

In this case, after chrome tanning, the substrate was treated with an acrylic retanning agent (Trupotan RKM), then a vegetable tannin (Mimosa WS) and followed by dyeing. After dyeing the substrate was fatliquored (Truposol LEX and Truposol AWL), then fixed with formic acid and washed.

Vacuum-dried crust leathers were cut to several equal sized pieces (20 cm×30 cm) having average dry weight of 89 g (±1 g). All of the sample pieces were adjusted to pH 6.2 with treatment cycles carried out in Dose drums (Ring Maschinenbau GmbH (Dose), Lichtenau, Germany) (model 08-60284 with an internal volume of 85 L) following the procedures in Table 3 and 4. Teknor Apex™ grade TA101M (Polyester—PET) supplied by Teknor Apex UK were used in the trials. The ullage (i.e. free space) in the drum for all trials was kept constant at 68%.

The samples were separately dyed with Trupocor Red 2B using 0.5, 1.0, 1.5 and 2.0% w/w of dye offer, i.e. dye quantity calculated based on the wet weight of the undyed crust samples. In each case, the four samples (average wet weight 740 g) and dyeing was carried out with reference to the procedure in Tables 3 and 4 and with a further low water control process as highlighted by the general conditions and steps indicated in Table 5.

TABLE 5

Trupocor Red 2B dye trials:

| Control Process 1 | PET Beads-water Process | Control Process 2 |
|---|---|---|
| Wet samples + water at pH 6.5 = 150% Float (1.2 L) + X % Trupocor Red 2B, Run 60 minutes + 0.5% formic acid, pH 4.0 Dyed leather, vacuum dried | Wet samples + water at pH 6.5 = 10% Float (80 mL) + Teknor Apex PET beads = 140% (1.1 L) + X % Trupocor Red 2B, Run 60 minutes + 0.5% formic acid, pH 4.0 Dyed leather, vacuum dried | Wet samples + water at pH 6.5 = 10% Float (80 mL) + X % Trupocor Red 2B, Run 60 minutes + 0.5% formic acid, pH 4.0 Dyed leather, vacuum dried |

In order to determine the dye concentration of the spent dye liquor and an estimation of dye wastage, samples of the exhausted dye liquors were taken after completion of each dyeing process and the dye concentrations in each samples was determined using a spectrophotometer (CM-2600d, Konica Minolta Europe GmbH, Langenhagen, Germany). Measurements of the colour were made using D65 as an illuminant at a 10° observer angle, with the specular component included. The dye exhaustion percentage values were calculated. Calibration curve for determination of dye concentration was prepared by measuring the absorbance of 0.25, 0.50, 0.75, 1.00 and 1.25 g/L solutions of Trupocor Red 2B (Trumpler GmbH, Worms, Germany) at 530 nm (absorption maxima of the dye). The average concentrations in the spent dye liquors were determined and the ratio of the obtained values to the initial dye concentrations (calculated based on initial dye application) were used to determine the percentage dye exhaustion.

The results for the control process (150% water), PET beads-water process and low water control process (10% water) are shown in Tables 5A, 5B and 5C below.

TABLE 5A

Control Process 1 (150% water):

| Dye % | Quantity of dye used (g) | Quantity Of Dye In Effluent (g) | % Dye Wastage |
|---|---|---|---|
| 0.5 | 3.70 | 0.67 | 18.2 |
| 1.0 | 7.40 | 1.28 | 17.3 |
| 1.5 | 11.10 | 1.80 | 16.2 |
| 2.0 | 14.80 | 2.33 | 15.7 |

TABLE 5B

PET Beads-Water Process (140% beads + 10% water):

| Dye % | Quantity of dye used (g) | Quantity Of Dye In Effluent (g) | % Dye Wastage |
|---|---|---|---|
| 0.5 | 3.70 | 0.15 | 3.94 |
| 1.0 | 7.40 | 0.26 | 3.49 |
| 1.5 | 11.10 | 0.64 | 5.76 |
| 2.0 | 14.80 | 0.92 | 6.24 |

TABLE 5C

Control Process 2 (10% water, No beads):

| Dye % | Quantity of dye used (g) | Quantity Of Dye In Effluent (g) | % Dye Wastage |
|---|---|---|---|
| 0.5 | 3.70 | 0.34 | 9.1 |
| 1.0 | 7.40 | 0.59 | 7.9 |
| 1.5 | 11.10 | 1.93 | 17.4 |
| 2.0 | 14.80 | 2.87 | 19.4 |

The result from dyeing with 10% water relative to substrate weight in the absence of PET beads (control process 2) indicated that a greater quantity of dye is lost to the effluent compared to the process including beads (using 10% water relative to substrate weight) and the conventional process (using standard 150% float relative to substrate weight, i.e. control process 1). The dye wastage to effluent for both the control processes was extremely high compared to the beads-water based process. It was also noted that the samples dyed in 10% water (control process 2 in absence of beads) showed excess dye-deposition at the surface and hence required twice the standard quantity of washing steps, and, furthermore, the dye penetration was also incomplete. Without being bound by theory, this is likely to be due to the greater potential for aggregation of dye particulates at the surface from the concentrated dye solution in the absence of beads. No excess deposition of dyes on the leather surface was observed with the beads-water system, and it is postulated that the beads inhibit dye aggregation at the leather surface in concentrated dye systems thereby allowing more efficient and effective dye diffusion throughout the hide.

Dye penetration was found to be incomplete in all of the samples dyed with 0.5% of dye. Similarly, the control samples with 1% of dye showed undyed portions at the centre of the cross-section. Above 0.5% dye usage, all samples dyed with the beads-water system showed complete penetration. The samples dyed with 1.5% and 2% of dye using the conventional process (control 1) showed complete penetration.

Figure 3:
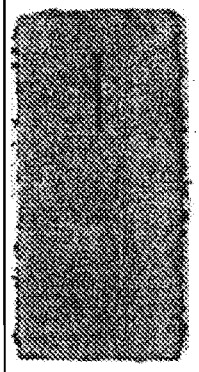
FIG. 3 shows images from an optical microscope of dyed crust-leather samples comparing beads-water and water-based control processes using different Trupocor 2B dye concentrations.
Figure 3:
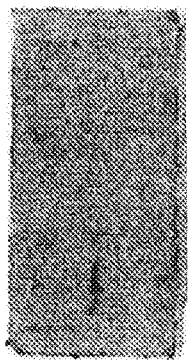
Figure 3:
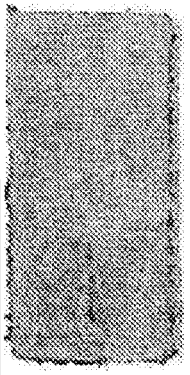
Figure 3:
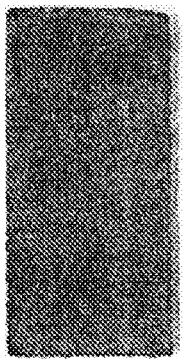
Figure 3:
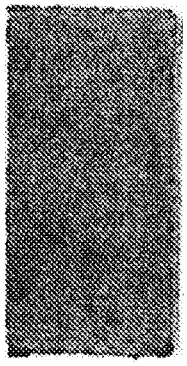
Figure 3:
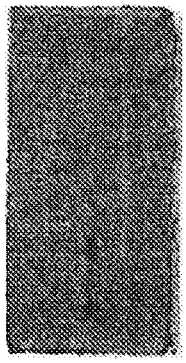
Figure 3:
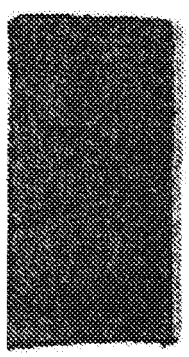
Figure 3:
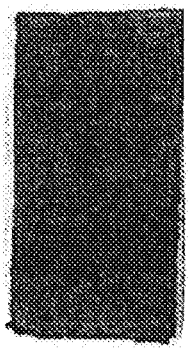
Figure 3:
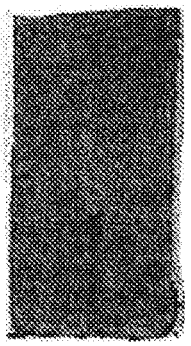
Figure 3:
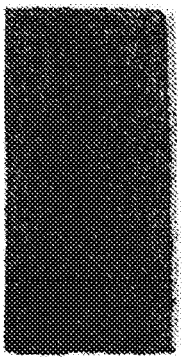
Figure 3:
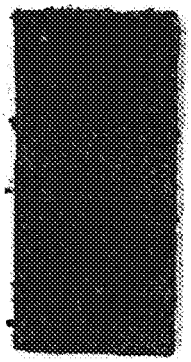
Figure 3:
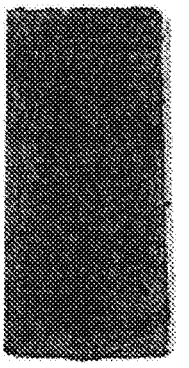

Referring now to FIG. 3, samples were analysed using optical microscopy (Model No. VHX-100k, Keyence Corporation, Osaka, Japan). The samples dyed with control 2 process (10% water), as illustrated by the images in the third column, all showed relatively lighter shade at all concentration levels compared to the beads-water process and the conventional control process 1. At 2% dye usage, the beads-water system clearly showed enhanced dye shade compared to the control samples. Furthermore, the beads-water system gave enhanced dyeing at a 93% water saving over the conventional control 1. Dyeing using the conventional process is carried out in a relatively dilute solution to avoid spontaneous fixation and deposition of dye at the surface. This preliminary dyeing experiment has indicated that the dye wastage observed in dyeing process with 150% water (conventional process, Control 1) may be reduced by 50% (at least) if the beads-water process is used. The dramatic reduction of dye wastage in the beads-water process is postulated to be due to increased dye absorption into the hide, which then increased the depth of colour shade. The inclusion of beads in the dyeing process and also using 10% of water compared to the substrate enabled enhanced penetration as well as greater diffusion of the dye into the leather. Whilst the low water control (Control 2) appeared to show improved surface dyeing compared to Control 1, it should be noted that the dye wastage to effluent is significantly higher, making such a process non-viable. This is likely to be due to relatively poor fixation, as the dye appeared to be concentrated at the surface which was removed during washing and subsequent processing, such as vacuum drying.

In addition, the unmilled, vacuum dried samples were analysed by a spectrophotometer (CM-2600d, Konica Minolta Europe GmbH, Langenhagen, Germany) to measure a* (redness) of the sample. The results are shown in Table 5D.

TABLE 5D

Comparison of a* at various Trupocor Red 2B dye concentrations:

| Dye Concentration (% w/w) | Control 1 (150% Water) (a*) | PET beads-water (140% beads, 10% water) (a*) | Control 2 (10% Water) (a*) |
|---|---|---|---|
| 0.5 | 27.20 | 36.28 | 28.84 |
| 1.0 | 30.74 | 39.50 | 37.15 |
| 1.5 | 39.62 | 41.00 | 42.29 |
| 2.0 | 38.74 | 44.00 | 43.23 |

Hue describes colour or shade of colour. It should be noted that the redness (measured by a*) for the beads-water sample using 1% w/w dye is higher than the redness (a*) for the control sample 1 using 2% w/w dye. Additionally, the redness (a*) for the control sample 1 using 1.5% w/w dye is similar to the beads-water sample using 1% w/w dye.

Additionally, the samples were analysed by a spectrophotometer to measure b* (blueness) of the sample. The results are shown in Table 5E.

TABLE 5E

| Comparison of b* at various Trupocor Red 2B dye concentrations: | | | |
|---|---|---|---|
| Dye Concentration (% w/w) | Control 1 (150% Water) (b*) | PET beads-water (140% beads, 10% water) (b*) | Control 2 (10% Water) (b*) |
| 0.5 | 2.90 | −6.32 | −4.92 |
| 1.0 | 0.02 | −6.76 | −6.28 |
| 1.5 | 0.31 | −5.47 | −6.29 |
| 2.0 | 3.00 | −6.06 | −5.52 |

With reference to Table 5E and Table 5D, as well as having high a* (redness), the beads-water sample also has highly negative b* (blueness) compared to the Control 1. A positive b* for the Control 1 process indicated indicated a yellow hue.

Hue can be determined using the hue angle calculation where:

$$\text{Hue angle } h_{ab} = \text{Arctan } b^*/a^*$$

The Hue angles were thus calculated for the various samples and are shown in Table 5F.

TABLE 5F

| Comparison of Hue angle at various Trupocor Red 2B dye concentrations: | | | |
|---|---|---|---|
| Dye Concentration (% w/w) | Control 1 (150% Water) Hue Angle ($h_{ab}$) | PET beads-water (140% beads, 10% water) Hue Angle ($h_{ab}$) | Control 2 (10% Water) Hue Angle ($h_{ab}$) |
| 0.5 | 0.11 | −0.17 | −0.17 |
| 1.0 | 0.00 | −0.17 | −0.17 |
| 1.5 | 0.01 | −0.13 | −0.15 |
| 2.0 | 0.08 | −0.14 | −0.13 |

Measurement of the Hue angle can allow the chroma to be calculated. The Chroma (i.e. the purity or intensity of colour/hue) can be defined as:

$$\text{Chroma } C^*_{ab} = [(a^*)^2 + (b^*)^2]^{0.5}$$

Table 5G below compares the Chroma (i.e. purity or intensity of colour/hue) for the various Trupocor Red 2B dye samples as the dye concentration is increased.

TABLE 5G

| Comparison of Chroma at various Trupocor Red 2B dye concentrations: | | | |
|---|---|---|---|
| Dye Concentration (% w/w) | Control 1 (150% Water) Chroma ($C^*_{ab}$) | PET beads-water (140% beads, 10% water) Chroma ($C^*_{ab}$) | Control 2 (10% Water) Chroma ($C^*_{ab}$) |
| 0.5 | 27.35 | 36.83 | 29.26 |
| 1.0 | 30.74 | 40.07 | 37.68 |
| 1.5 | 39.62 | 41.36 | 42.76 |
| 2.0 | 38.86 | 44.42 | 43.58 |

As shown in Table 5G, the beads-water samples at dye concentrations from 0.5-2.0% w/w yield a higher chroma (colour/hue intensity) compared to the Control 1 (i.e. conventional process). As noted above for Control 2, there is inadequate dye fixation, surface dye deposition and excessive losses of dye to effluent suggesting that the use of such a water-based dye system would be non-viable.

Figure 4:
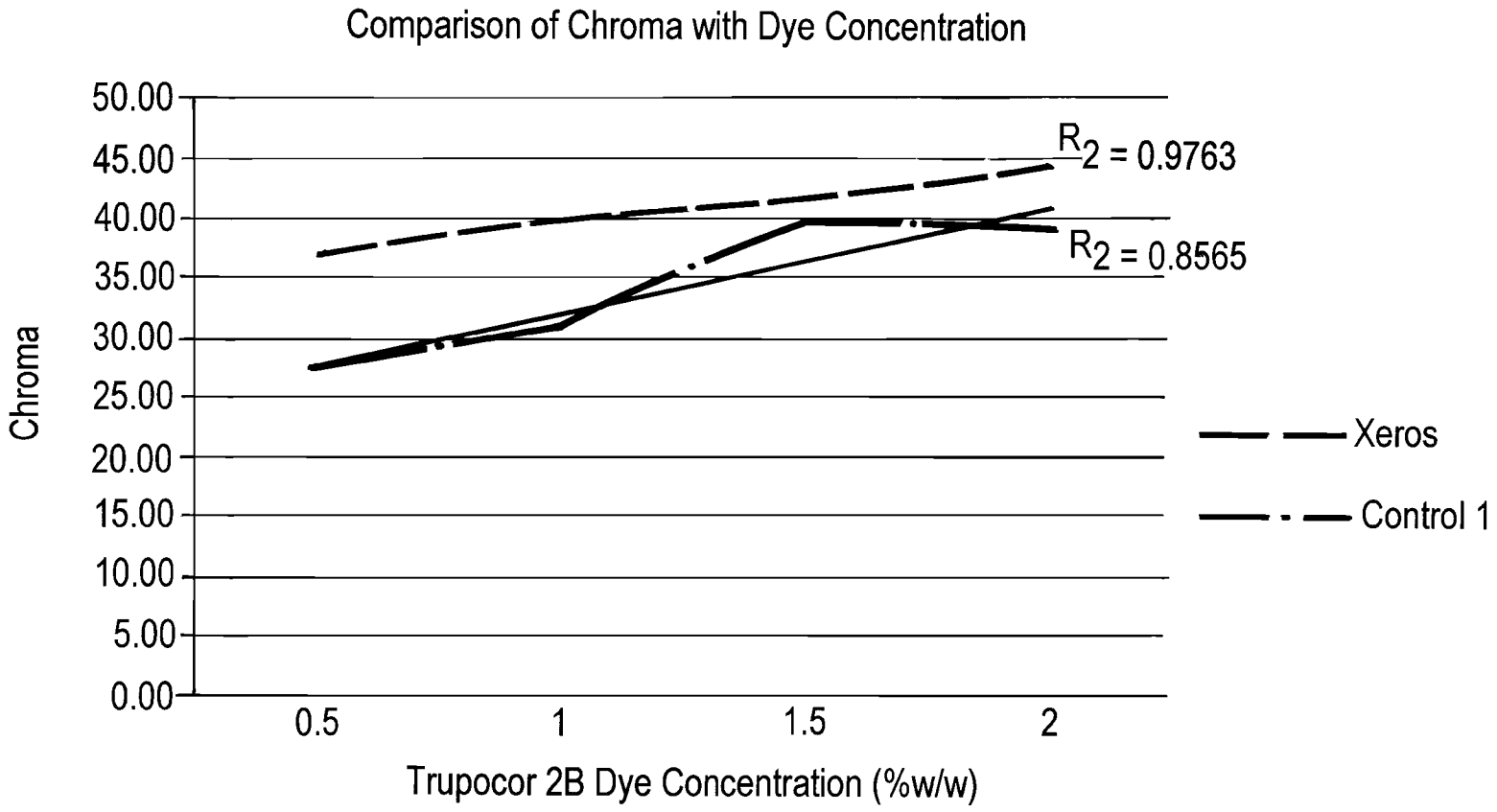
FIG. 4 shows a graph of chroma for the PET beads-water and Control 1 samples at different Trupocor Red 2B dye concentrations. The PET beads-water sample (Xeros) is represented by the upper line with $R^2$ value of 0.9763 and the Control 1 sample is represented by the lower line with $R^2$ value of 0.8565.

Furthermore, as shown In FIG. 4, it can be demonstrated that there is a significantly higher correlation between chroma and dye concentration for the beads-water sample compared to the control. This improved correlation, when combined with a consistent hue angle as the dye concentration increases, has the benefit that a leather manufacturer can potentially control the dyeing characteristics of the finished leather more effectively thereby minimising rework and/or expensive finishing techniques to minimise dyeing variability.

After a drying and milling stage, the PET beads-water sample and corresponding controls from the 2% w/w dyeing experiments were subjected to physical testing as shown in Table 5H.

TABLE 5H

| Comparison of physical testing performance following treatment with Trupocor Red 2B dye | | | | | |
|---|---|---|---|---|---|
| Process | Tear Load (MPa) (BS EN ISO 3376: 2011) | Tear Strength (kN/m) (BS EN ISO 3376: 2011) | Tensile Strength (BS EN ISO 3376: 2011) (MPa) | Elongation At Break (BS EN ISO 3376: 2011) (%) | Apparent Density (BS EN ISO 2420: 2002) (g/cm$^3$) |
| Control 1 | 70.4 | 313.5 | 18.2 | 57.4 | 0.614 |
| PET beads-water | 65.4 | 309.3 | 20.4 | 54.6 | 0.655 |
| Control 2 | 55.8 | 411.0 | 12.1 | 36.4 | 0.624 |

The table above indicated that the PET beads-water treatment produced leather with tear load, tear strength, tensile strength and elongation at break similar to the Control 1 process. The apparent density of the PET beads-water produced leather was slightly denser than the Control 1 process. The physical properties for control 2 were generally inferior than the Control 1 and PET beads-water samples for tear load, tensile strength and elongation at break.

Example 2B—Dyeing with Trupocor Red EN

Samples were prepared in accordance with the process as previously described in Table 3 and Table 4 above and in respect of the dyeing experiments with Trupocor Red 2B.

The samples were separately dyed with Trupocor Red EN using 2.0% w/w of dye offer, i.e. dye quantity calculated based on the wet blue weight. Dyeing was carried out with reference to the procedure in Tables 3 and 4 and with a further low water control process as highlighted by the general conditions and steps indicated in Table 6.

TABLE 6

| Trupocor Red EN dye trials: | | |
|---|---|---|
| Control process 1 | PET Beads-water process | Control process 2 |
| Wet samples + water at pH 6.5 = 150% (1.2 L) + 2% Trupocor Red EN Run 60 minute + 0.5% formic acid, pH 4.0 Dyed leather, vacuum dried | Wet samples + water at pH 6.5 = 10% (80 mL) + Teknor apex beads = 140% (1.1 L) + 2% Trupocor Red EN, Run 60 minute + 0.5% formic acid, pH 4.0 Dyed leather, vacuum dried | Wet samples + water at pH 6.5 = 10% (80 mL) + 2% Trupocor Red EN, Run 60 minute + 0.5% formic acid, pH 4.0 Dyed leather, vacuum dried |

In order to determine the dye concentration of the spent dye liquor and an estimation of dye wastage, samples of the exhausted dye liquors were taken after completion of each dyeing process and the dye concentrations in each samples was determined spectrophotometrically. The dye exhaustion percentage values were calculated. Calibration curve for determination of dye concentration was prepared by measuring the absorbance of 10, 20, 50, and 100 mg/L solutions of Trupocor Red EN (Trumpler GmbH, Worms, Germany) at 510 nm (absorption maxima of the dye). The average concentrations in the spent dye liquors were determined and the ratio of the obtained values to the initial dye concentrations (calculated based on initial dye application) were used to determine the percentage dye exhaustion.

The results for the control process (150% water), PET beads-water process and low water control process (10% water) are shown in Tables 6A, 6B and 6C below.

TABLE 6A

| Control Process 1 (150% water): | | | |
|---|---|---|---|
| Dye % | Quantity of dye used (g) | Quantity Of Dye In Effluent (g) | % Dye Wastage |
| 2.0 | 210.0 | 38.71 | 18.4 |

TABLE 6B

| PET Beads-Water Process (140% Beads + 10% Water): | | | |
|---|---|---|---|
| Dye % | Quantity of dye used (g) | Quantity Of Dye In Effluent (g) | % Dye Wastage |
| 2.0 | 210.0 | 20.67 | 9.84 |

TABLE 6C

| Control Process 2 (10% Water, No Beads): | | | |
|---|---|---|---|
| Dye % | Quantity of dye used (g) | Quantity Of Dye In Effluent (g) | % Dye Wastage |
| 2.0 | 210.0 | 25.92 | 12.34 |

The result from dyeing with 10% water relative to substrate weight in the absence of PET beads (control process 2) and the conventional process (using standard 150% float relative to substrate weight, i.e. control process 1) indicated that a greater quantity of dye is lost to the effluent compared to the process including beads (using 10% water relative to substrate weight). The dye wastage to effluent for both the control processes was extremely high compared to the PET beads-water process. It was also noted that the samples dyed in 10% water (control process 2 in absence of beads) showed excess dye-deposition at the surface and hence required twice the standard quantity of washing steps, and, furthermore, the dye penetration was also incomplete. No excess deposition of dyes on the leather surface was observed however with the beads-water system. Dyeing with the beads-water system showed complete dye penetration and, as there is less dye wastage as compared to control process 2, indicated that the action of beads in the dyeing media have enhanced absorption of dye into the fibrous structure of the leather.

Figure 5:
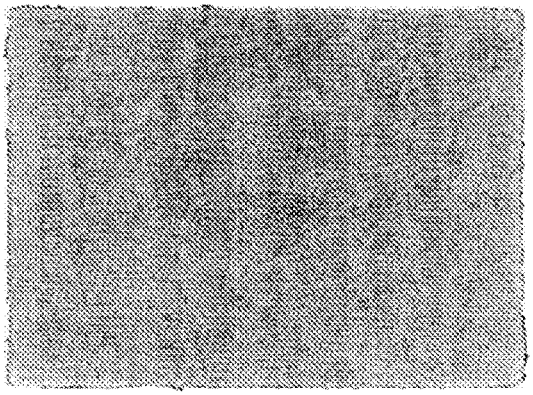
FIG. 5 shows images from an optical microscope of dyed crust-leather samples comparing beads-water and water-based control processes using a 2% concentration of Trupocor EN dye. The top sample illustrates a dyed sample using a Substrate (S):Water (W):Beads (B) ratio of 10:1:14, the middle sample illustrates a dyed sample using a Substrate (S):Water (W):Beads (B) ratio of 10:15:0 and the bottom sample illustrates a dyed samples using a Substrate (S):Water (W):Beads (B) ratio of 10:1:0.
Figure 5:
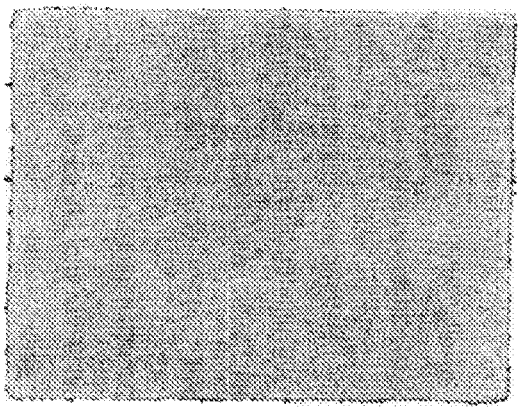
Figure 5:
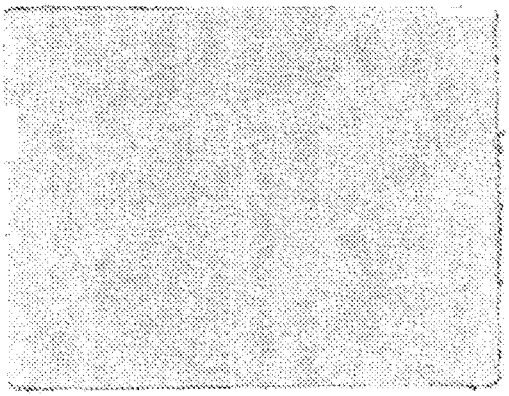

Referring now to FIG. 5, samples were analysed using optical microscopy (Model No. VHX-100k, Keyence Corporation, Osaka, Japan). A comparison between the top sample (10% water and beads), middle sample (150% water) and bottom sample (10% water, no beads) indicates that the water-based system which further incorporates PET-beads, yields superior colour/hue intensity compared to the water-only control samples.

After a drying and milling stage, the PET-bead water sample and corresponding controls from the 2% w/w dyeing experiments were subjected to physical testing as shown in Table 6D.

TABLE 6D

| Comparison of physical testing performance following treatment with Trupocor Red EN dye: | | | | | |
|---|---|---|---|---|---|
| Process | Tear Load (MPa) (BS EN ISO 3376: 2011) | Tear Strength (kN/m) (BS EN ISO 3376: 2011) | Tensile Strength (BS EN ISO 3376: 2011) (MPa) | Elongation At Break (BS EN ISO 3376: 2011) (%) | Apparent Density (BS EN ISO 2420: 2002) ($g/cm^3$) |
| Control 1 | 32.5 | 303.5 | 16.3 | 38.6 | 0.687 |
| PET beads-water | 48.7 | 370.3 | 18.4 | 48.7 | 0.714 |
| Control 2 | 20.4 | 179.0 | 11.2 | 39.4 | 0.686 |

The table above indicated that the PET beads-water treatment produced leather with tear load, tear strength, tensile strength and elongation at break substantially superior to the Control 1 and Control 2 samples. The apparent density of the PET beads-water produced leather was slightly denser than for the Control 1 and Control 2 process. The physical properties for Control 2 were substantially inferior than the PET beads-water samples for tear load, tensile strength and elongation at break. The Control 2 sample was also generally inferior to the Control 1 sample, except for elongation at break.

Example 2C—Dyeing with Trupocor Red EN Using a Modified Process

Samples were prepared in accordance with the process as previously described in Table 3 and Table 4 above and in respect of the dyeing experiments with Trupocor Red EN but with the exception that after chrome tanning, the substrate was treated with a vegetable tannin (Mimosa WS) immediately prior to dyeing. After dyeing the substrate was treated with the acrylic retanning agent (Trupotan RKM), then fatliquored (Truposol LEX and Truposol AWL) and then fixed with formic acid and washed. For the modified process, the acrylic retanning agent (Trupotan RKM) was therefore introduced after the dyeing process.

The samples were separately dyed with Trupocor Red EN using 2.0% w/w of dye offer, i.e. dye quantity calculated based on the wet blue weight. Dyeing was carried out with reference to the procedure in Tables 3 and 4 and with a further low water control process as highlighted by the general conditions and steps indicated in Table 7.

TABLE 7

| Trupocor Red EN dye trials (modified process): | | |
|---|---|---|
| Control process 1 | PET Beads-water process | Control process 2 |
| Wet samples + water at pH 6.5 = 150% (1.2 L) + 2% Trupocor Red EN Run 60 minute + 0.5% formic acid, pH 4.0 Dyed leather, vacuum dried | Wet samples + water at pH 6.5 = 10% (80 mL) + Teknor apex beads = 140% (1.1 L) + 2% Trupocor Red EN, Run 60 minute + 0.5% formic acid, pH 4.0 Dyed leather, vacuum dried | Wet samples + water at pH 6.5 = 10% (80 mL) + 2% Trupocor Red EN, Run 60 minute + 0.5% formic acid, pH 4.0 Dyed leather, vacuum dried |

In order to determine the dye concentration of the spent dye liquor and an estimation of dye wastage, samples of the exhausted dye liquors were taken after completion of each dyeing process and the dye concentrations in each samples was determined spectrophotometrically. The dye exhaustion percentage values were calculated. Calibration curve for determination of dye concentration was prepared by measuring the absorbance of 10, 20, 50, and 100 mg/L solutions of Trupocor Red EN (Trumpler GmbH, Worms, Germany) at 510 nm (absorption maxima of the dye). The average concentrations in the spent dye liquors were determined and the ratio of the obtained values to the initial dye concentrations (calculated based on initial dye application) were used to determine the percentage dye exhaustion.

The results for the control process (150% water), PET beads-water process and low water control process (10% water) for Trupocor Red EN dye following the modified process are shown in Tables 7A, 7B and 7C below.

TABLE 7A

| Control Process 1 (150% Water): | | | |
|---|---|---|---|
| Dye % | Quantity of dye used (g) | Quantity Of Dye In Effluent (g) | % Dye Wastage |
| 2.0 | 210.0 | 43.82 | 20.87 |

TABLE 7B

| PET Beads-Water Process (140% Beads + 10% Water): | | | |
|---|---|---|---|
| Dye % | Quantity of dye used (g) | Quantity Of Dye In Effluent (g) | % Dye Wastage |
| 2.0 | 210.0 | 9.07 | 4.32 |

TABLE 7C

| Control Process 2 (10% Water, No Beads): | | | |
|---|---|---|---|
| Dye % | Quantity of dye used (g) | Quantity Of Dye In Effluent (g) | % Dye Wastage |
| 2.0 | 210 | 15.24 | 7.25 |

The result from dyeing with 10% water relative to substrate weight in the absence of PET beads (control process 2) and the conventional process (using standard 150% float relative to substrate weight, i.e. control process 1) indicated that a greater quantity of dye is lost to the effluent compared to the process including beads (using 10% water relative to substrate weight). The dye wastage to effluent for both the control processes was extremely high compared to the PET beads-water process. It was also noted that the samples dyed in 10% water (control process 2 in absence of beads) showed excess dye-deposition at the surface and hence required twice the standard quantity of washing steps, and, furthermore, the dye penetration was also incomplete. No excess deposition of dyes on the leather surface was observed however with the beads-water system.

It was also observed that less dye was wasted to effluent in the modified process compared to the unmodified process in example 2B for the PET beads-water sample (i.e. 9.07 g dye wasted to effluent for the modified process versus 20.67 g dye wasted to effluent for the unmodified process), whereas for the Control 1 sample greater quantities of dye was wasted to effluent in the modified process compared to the standard process (i.e. see 43.82 g dye wasted to effluent for the modified process versus 38.71 g dye wasted to effluent for the unmodified process).

After a drying and milling stage, the PET-bead water sample and corresponding controls from the 2% w/w dyeing experiments were subjected to physical testing as shown in Table 7D.

TABLE 7D

Comparison of physical testing performance following treatment with Trupocor Red EN dye using the modified process:

| Process | Tear Load (MPa) (BS EN ISO 3376: 2011) | Tear Strength (kN/m) | Tensile Strength (BS EN ISO 3376: 2011) (MPa) | Elongation At Break (BS EN ISO 3376: 2011) (%) |
|---|---|---|---|---|
| Control 1 | 49.2 | 407.0 | 12.7 | 52.2 |
| PET beads-water | 60.2 | 511.0 | 14.4 | 64.4 |
| Control 2 | 45.7 | 337.0 | 12.1 | 36.4 |

The table above indicated that the PET beads-water treatment produced leather with tear load, tear strength, tensile strength and elongation at break substantially superior to the Control 1 and Control 2 samples. The physical properties for Control 2 were generally inferior compared to the Control 1 and the PET beads-water samples for tear load, tear strength, tensile strength and elongation at break The modified process appeared to increase the tear load, tear strength but not the tensile strength over the unmodified process for the Control 1 and PET beads-water samples when comparing the results in Table 7D to those in Table 6D. The elongation at break for Control sample 2 was reduced when samples were prepared using the modified process. The tear load, tear strength and the tensile strength were however increased for Control sample 2 using the modified procedure.

Example 2D—Dyeing with Trupocor Brown GST Using a Modified Process

Samples were prepared in accordance with the modified process as previously described above in respect of Example 2C for Trupocor Red EN.

The samples were separately dyed with Trupocor Brown GST using 2.0% w/w of dye offer, i.e. dye quantity calculated based on the wet blue weight. Dyeing was carried out with reference to the procedure in Tables 3 and 4 and with a further low water control process as highlighted by the general conditions and steps indicated in Table 8.

TABLE 8

Trupocor Red EN dye trials (modified process):

| Control process 1 | PET Beads-water process | Control process 2 |
|---|---|---|
| Wet samples + water at pH 6.5 = 150% (1.2 L) + 2% Trupocor Brown GST Run 60 minute + 0.5% formic acid, pH 4.0 Dyed leather, vacuum dried | Wet samples + water at pH 6.5 = 10% (80 mL) + Teknor apex beads = 140% (1.1 L) + 2% Trupocor Brown GST, Run 60 minute + 0.5% formic acid, pH 4.0 Dyed leather, vacuum dried | Wet samples + water at pH 6.5 = 10% (80 mL) + 2% Trupocor Brown GST, Run 60 minute + 0.5% formic acid, pH 4.0 Dyed leather, vacuum dried |

In order to determine the dye concentration of the spent dye liquor and an estimation of dye wastage, samples of the exhausted dye liquors were taken after completion of each dyeing process and the dye concentrations in each samples was determined spectrophotometrically. The dye exhaustion percentage values were calculated. Calibration curve for determination of dye concentration was prepared by measuring the absorbance of 10, 20, 40, and 100 mg/L solutions of Trupocor Brown GST (Trumpler GmbH, Worms, Germany) at 420 nm (absorption maxima of the dye). The average concentrations in the spent dye liquors were determined and the ratio of the obtained values to the initial dye concentrations (calculated based on initial dye application) were used to determine the percentage dye exhaustion.

The results for the control process (150% water), PET beads-water process and low water control process (10% water) are shown in Tables 8A, 8B and 8C below.

TABLE 8A

Control Process 1 (150% Water):

| Dye % | Quantity of dye used (g) | Quantity Of Dye In Effluent (g) | % Dye Wastage |
|---|---|---|---|
| 2.0 | 210.0 | 43.14 | 20.54 |

TABLE 8B

PET Beads-Water Process (140% Beads + 10% Water):

| Dye % | Quantity of dye used (g) | Quantity Of Dye In Effluent (g) | % Dye Wastage |
|---|---|---|---|
| 2.0 | 210.0 | 8.44 | 4.01 |

TABLE 8C

Control Process 2 (10% Water, No Beads):

| Dye % | Quantity of dye used (g) | Quantity Of Dye In Effluent (g) | % Dye Wastage |
|---|---|---|---|
| 2.0 | 210.0 | 11.81 | 5.62 |

The results were similar to the modified Trupocor Red EN processes noted in Example 2C above. The result from dyeing with 10% water relative to substrate weight in absence of PET beads (control process 2) and the conventional process (using standard 150% float relative to substrate weight, i.e. control process 1) indicated that greater quantities of dye were lost to the effluent compared to beads-water process (using 10% water relative to substrate weight). The dye wastage to effluent for the Control 1 process was significantly higher compared to the PET beads-water process. It was also noted that the samples dyed in 10% water (control sample 2 in absence of beads) showed excess dye-deposition at the surface and hence required twice the standard quantity of washing steps, and, furthermore, the dye penetration was also incomplete. No excess deposition of dyes on the substrate surface was observed with the PET beads-water system.

Figure 6:
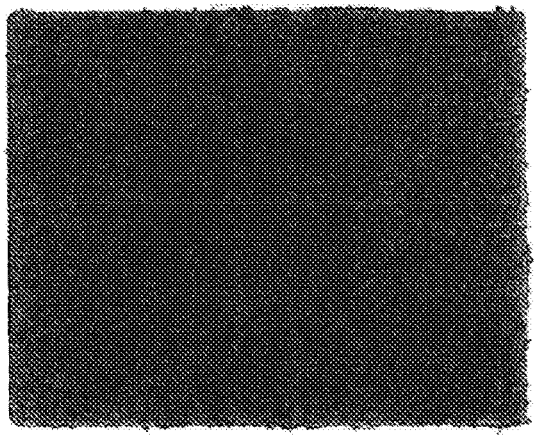
FIG. 6 shows images from an optical microscope of dyed crust-leather samples comparing beads-water and water-based control processes using a 2% concentration of Trupocor Brown GST dye when carried out using a modified preparation process. The top sample illustrates a dyed sample using a Substrate (S):Water (W):Beads (B) ratio of 10:1:14, the middle sample illustrates a dyed sample using a Substrate (S):Water (W):Beads (B) ratio of 10:15:0 and the bottom sample illustrates a dyed samples using a Substrate (S):Water (W):Beads (B) ratio of 10:1:0.
Figure 6:
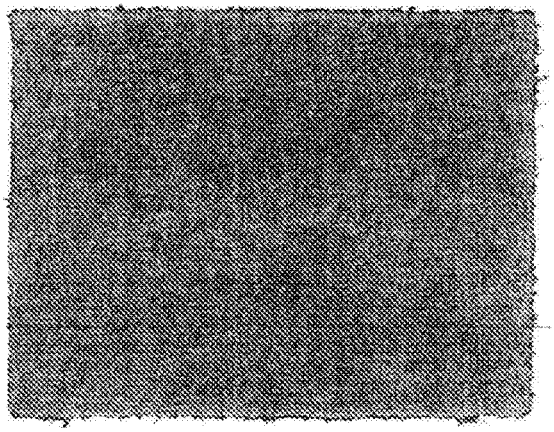
Figure 6:
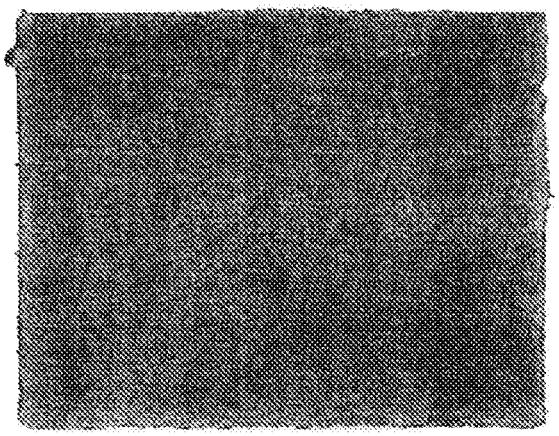

Referring now to FIG. 6, samples were analysed using optical microscopy (Model No. VHX-100k, Keyence Corporation, Osaka, Japan). A comparison between the top sample (10% water and beads), middle sample (150% water) and bottom sample (10% water, no beads) indicates that the water-based system which further incorporates PET-beads, yields superior colour/hue intensity compared to the water-only control samples for the Trupocor Brown GST dye.

Example 3—Bead Reuse in Dyeing

A further experiment was conducted to assess degradation or chemical modification following reuse of the polymeric particles in the dyeing process. Teknor Apex™ grade TA101M (Polyester—PET) supplied by Teknor Apex UK were used in the trials. A first procedure was carried out whereby undyed crust leathers comprising wet-blue hides (thickness 1.8 mm) were retanned with an acrylic retanning agent (Trupotan RKM), then a vegetable tannin (Mimosa WS) following the conditions noted in Table 4 above. After the retanning treatment, the leather substrate was dyed using Trupocor Red 2B with 2.0% w/w of dye offer in accordance with the procedure outlined in Example 2A above.

The PET-beads used in the first retanning procedure were subsequently used in the dyeing step. Samples of the beads used in the retanning step and also following their use in the dyeing treatment were subjected to differential scanning calorimetry (DSC) to determine the onset temperature and hence whether there had been any composition changes to the beads. If the onset temperatures remained within a narrow range then this would indicate that dyeing had no adverse effect on the beads and that the beads could be recycled and reused. DSC analysis was carried out in a Mettler Toledo 822e DSC and was scanned at 15° C./minute, with reference to an empty weighed, pierced aluminium pan. Thermograms were analysed using Star Software (v 1.13) recording onset/peak temperature and normalised integral.

The DSC onset temperature for the PET beads after the retanning step was measured as 138.38° C. Following dyeing of the substrate using Trupocor Red 2B, the DSC onset temperature was 136.52° C. The DSC onset temperature showed little change and was considered to be within a range accounted for by by error associated with the experimental technique alone. The results therefore indicated that dyeing with Trupocor Red 2B did not cause degradation or chemical modification of the PET beads demonstrating that the beads could be recycled and reused.

Example 4—Further Dyeing Studies Conducted on Goatskins

Goatskin of UK origin (Latco Ltd, Cheshire, UK) was processed as a batch until the chromium tanned wet blue stage had been completed. First, the goatskin was subjected to beamhouse operations including soaking, reliming, deliming, bating and pickling before the tanning stage. The beamhouse and tannage processes for the goatskins are summarised in Table 9 below.

TABLE 9

Beamhouse and tannage for goatskins: % refers to substrate weight

| Process | % | Chemical | T(° C.) | Time | Comments |
|---|---|---|---|---|---|
| Soaking | 400 | Water | 26 | | |
| | 3 g/L | Eusapon OC | | | |
| | 1 g/L | Preventol Z-L | | 6 h | |
| Drain | | | | | |
| Green Flesh, Paint unhairing Leave for 3 h, pull and reweigh | | | | | |

| Process | % | Chemical | T ° C. | Time | Comments |
|---|---|---|---|---|---|
| Reliming | 400 | Water | 24 | | |
| | 0.1 | Eusapon OC | | | |
| | 0.2 | $Na_2S$ | | | |
| | 1.5 | Lime | | 20 h | 5'/60' |
| Drain | | | | | |
| Wash | 200 | Water | 35 | 10 min | |
| Drain | | | | | |
| Wash | 200 | Water | 35 | 10 min | |
| Drain | | | | | |
| Deliming | 100 | Water | 35 | | |
| | 2.5 | Ammonium chloride | | | phenolphthalein, pH |
| | 0.3 | Sodium m-bisulphite | | 45 min | |
| Bating+ | 0.5 | Oropon ON2 | | 120 min | Thumb print |
| Drain | | | | | |
| Washing | 200 | Water | Cold | 10 min | |
| Drain | | | | | |
| Pickling | 50 | Water | 35 | | |
| | 5 | Sodium chloride | | 5 min | |
| + | 0.8 | Sulphuric acid (1:10) | | 120 min | pH |
| | 0.8 | Formic acid (1:10) | | | bromocresol green |
| Tanning+ | 4.5 | Baychrome A | | | Run till penetrated and then start heating cycle |

Eusapon ® and Baychrome ® - BASF SE, Ludwigshafen, Germany; Oropon ® - TFL Ledertechnik GmbH, Weil Am Rhein, Germany Treatment cycles were carried out in Simplex-4 drums (Inoxvic, Barcelona, Spain). The chrome tanned leather (Vet blue') was shaved to 1.2±0.1 mm and weighed as damp shaved weight. Leathers were processed according to the post tanning procedure in Table 10 below with particular focus on the neutralisation pH being 5.5±0.3 and the fixation pH being 3.5±0.1. Samples were collected and stored for analysis. The dyestuff used for the dye study was Trupocor Red EN (Trumpler GmbH, Worms, Germany) and a standard solution of 100 mg/L was made up. A standard curve of the absorbance of Trupocor Red EN was generated using a blank, 10, 20, 50 and 100 mg/L at 530 nm.

The preparation of the goatskin substrates prior to the dyeing stage was thus carried out in the absence of particles (i.e. using a conventional, water-based process). Leathers were then processed according to Table 10 below either using particles to replace the float or using a conventional post tanning recipe with conventional process water quantities. A 150% w/w process water quantity would be added to the recipe at various stages of the retanning/dyeing/fatliquoring operations.

TABLE 10

Post tanning procedure and recipe for goatskins: % refers to substrate weight

| Process | % | Chemical | T ° C. | Time | Comments |
|---|---|---|---|---|---|
| Wet Back | 200 | Water | 35 | | |
| | 0.2 | Oxalic acid | | 15 | |
| Drain | | | | | |
| Neutralise | 100 | Water | 40 | | |
| | 0.5 | Sodium formate | | | |
| | 1.5 | Sodium bicarbonate (1:3) | | 15 | |
| + | 1 | Neutraktan NT | | | |
| | 1 | Kurtalicker S | | 60 | pH = 5.5 |
| Drain | | | | | |
| Retan/Dye/ Fatliquor | X* | Water | 40 | | |
| | 4 | Tanicor PWB | | | |
| | 8 | Mimosa FS | | | |
| | 2 | Trupocor Red EN | | 30 | |
| + | X* | Water | 60 | | Blend together |
| | 5 | Magnopal SOF | | | |
| | 4 | Trupotan AMP | | | |
| | 4.4 | Trupol RD | | | |
| | 2.1 | Truponol FG | | | |
| | 1 | Salem EXP | | 45 | |
| Fix+ | 1 | Formic acid (1:10) | | 10 | |
| + | 0.5 | Formic acid (1:10) | | 10 | |
| + | 0.5 | Formic acid (1:10) | | | pH = 3.5 |
| | 0.5 | Trupon SYN | | 10 | |
| Drain | | | | | |
| Wash x 2 | 200 | Water | 35 | 10 | |
| Drain | | | | | |

Neutraktan ® and Salem ®(Stahl, Waalwijk, Netherlands); Kurtalicker ®(Silvateam, Piedmont, Italy) Tanicor ®(Clariant Ltd, Muttenz, Switzerland); Mimosa ®(Forestal Mimosa, Reading, UK) Trupocor ®, Trupon ® and Trupol ® (Trumpler Gmbh, Worms, Germany) X* - Water quantity varied according to whether it was a particle assisted or non-assisted (conventional) recipe. For particle assisted treatments a substrate:particles:water % w/w ratio of 1.0:1.4:0.1 was used and thus X* was 10. For a conventional water control (CWC), a substrate:water % w/w ratio of 1.0:1.5 was used and thus X* was 150. For low water controls (LWC) based on a substrate: water % w/w ratio of 1.0:0.1 (i.e. equivalent to the quantity of water used for the particle assisted process) X* was 10.

A series of polymeric and non-polymeric particles were independently used in the dyeing process having the characteristics outlined in Table 11.

TABLE 11

Comparison of different particle types used in the dyeing process:

| Particle | Composition | Shape | Longest Dimension (mm) | Medium Dimension (mm) | Shortest Dimension (mm) | Density ($g/cm^3$) | Surface Area Per Particle ($mm^2$) |
|---|---|---|---|---|---|---|---|
| Glass | Glass | Spherical | 4.71 | 4.71 | 4.71 | 3.49 | 69.7 |
| Ceramic (Baking) beads | Ceramic | Ellipsoid | 10.53 | 10.07 | 10.04 | 2.31 | 327.9 |
| Squash Balls | Rubber | Spherical | 39.7 | 39.7 | 39.7 | 0.74 | 4937.3 |
| Teknor Apex PET 101 | PET | Ellipsoid | 4.24 | 3.67 | 3.34 | 1.365 | 44.26 |
| Technyl XA1493 | Nylon 6,6 | Ellipsoid | 4.79 | 3.59 | 3.29 | 1.496 | 47.16 |

Ceramic beads (Ceramic baking beans grade, Lakeland Limited, Windermere, UK), Squash balls (Unsquashable squash ball grade, Sports Ball Shop, Garford, UK), glass beads (Worf Glaskugeln GmbH, Mainz, Germany) were used as supplied.

For dyeing, a substrate:particles:water % w/w ratio of 1.0:1.4:0.1 was used as a basis for the particle trials, with the assumption that Teknor Apex PET beads were used. Particle surface area was normalised (assuming that the Teknor Apex PET surface area had a relative surface area of 1.0) so that identical particle surface area was presented to the skin for each of the particles used. Two control samples without particles were additionally included, a conventional water control (CWC) based on a substrate:water % w/w ratio of 1.0:1.5 and a low water control (LWC) based on a substrate: water % w/w ratio of 1.0:0.1.

The total volume of effluents from the dye studies were recorded and samples from these effluents were diluted using a 1:100 dilution. Samples were read on a spectrophotometer (CM-2600d, Konica Minolta Europe GmbH, Langenhagen, Germany) and the absorbance recorded. Concentrations were calculated using a linear regression of the curve generated in the standard curve and exhaustion rates calculated as seen in Table 12 below. The exhaustion indicates the percentage of the quantity of dye used that has not been wasted in the effluent.

TABLE 12

Dye exhaustion studies showing different particle types in comparison to respective low water controls:

| Sample | Quantity Of Dye Used (Offer of 2% w/w) (g) | Quantity Of Dye In Effluent (g) | Exhaustion (%) |
|---|---|---|---|
| PET Beads (LWC) | 12.0 | 0.230 | 98.08 |
| PET Beads | 12.0 | 0.141 | 98.83 |
| Nylon 6,6 Beads (LWC) | 12.0 | 0.155 | 98.71 |
| Nylon 6,6 Beads | 12.0 | 0.092 | 99.24 |
| Ceramic beads (LWC) | 12.0 | 0.717 | 94.03 |
| Ceramic beads | 12.0 | 0.653 | 94.56 |
| Glass beads (LWC) | 12.0 | 1.027 | 94.44 |

TABLE 12-continued

Dye exhaustion studies showing different particle types in comparison to respective low water controls:

| Sample | Quantity Of Dye Used (Offer of 2% w/w) (g) | Quantity Of Dye In Effluent (g) | Exhaustion (%) |
|---|---|---|---|
| Glass beads | 12.0 | 0.676 | 96.34 |
| Squash Balls (LWC) | 12.0 | 0.287 | 97.61 |
| Squash Balls | 12.0 | 0.268 | 97.77 |

The table above indicated that polymeric and non-polymeric particles can produce improved dye absorption into the substrate and decreased quantity of dye in effluent compared to respective control samples without particles. Furthermore, the presence of the particles reduced the losses of dye to effluent.

In a further experiment to compare dye shade between controls and the various particle types highlighted in Table 11, goatskins of UK origin (Latco Ltd, Cheshire, UK) were dyed with Trupocor Red EN dye using the same process as previously outlined above. The leathers were not sammy set (as goat nappa is usually processed) but were toggle dried with medium set after horsing up overnight. Leathers were then carefully unclipped and then placed into a conditioning room before measured by Konica Minolta handheld spectrophotometer. Measurements of the colour were made using D65 as an illuminant at a 10° observer angle, with the specular component included. Target shade was established as polymeric and non-polymeric particles in the conventional water control (CWC) process were absent and water levels were conventional. Measurements for a low water control (LWC) as outlined above were also obtained and the results are shown in Table 13 below.

TABLE 13

CIELAB quantitative data from dye shade comparisons comparing the influence of shade between various particle types:

| Sample | a* | b* |
|---|---|---|
| CWC | 41.40 | 7.26 |
| PET Beads (LWC) | 40.31 | 8.46 |
| PET Beads | 40.54 | 8.88 |
| Nylon 6,6 (LWC) | 41.69 | 9.65 |
| Nylon 6,6 | 39.46 | 8.51 |
| Ceramic beads (LWC) | 33.89 | 5.35 |
| Ceramic beads | 40.54 | 7.15 |
| Glass beads (LWC) | 44.33 | 11.69 |
| Glass beads | 41.83 | 8.00 |
| Squash Balls (LWC) | 40.91 | 11.69 |
| Squash Balls | 39.40 | 5.34 |

The particles used appeared to produce a range of a* and b* values which were similar in most cases to that of the control samples. Thus it appeared that polymeric and non-polymeric particles were capable of producing satisfactorily dyed leather. Indeed it can be shown that the use of different polymeric and non-polymeric particles offers potential for introducing additional leather finishing techniques.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for treating an animal substrate comprising:

agitating a moistened animal substrate with an aqueous treatment formulation and a solid particulate material in a sealed apparatus, wherein the aqueous treatment formulation comprises at least one colourant, and wherein the solid particulate material comprises a multiplicity of polymeric particles, a multiplicity of non-polymeric particles, or a mixture of a multiplicity of polymeric and non-polymeric particles, wherein the polymeric or non-polymeric particles have an average particle diameter of from 0.1 mm to 500 mm and/or a length of from 0.1 to 500 mm, and wherein the animal substrate is hide, skin or leather.

2. The method according to claim 1 wherein the sealed apparatus comprises a treatment chamber in the form of a rotatably mounted drum or a rotatably mounted cylindrical cage and wherein the method comprises agitating said animal substrate and said treatment formulation by rotating said treatment chamber.

3. The method according to claim 1 wherein at least some of the colourant applied to the animal substrate originates from the treatment formulation.

4. The method according to claim 1 wherein all of the colourant applied to the animal substrate originates from the treatment formulation.

5. The method according to claim 1 wherein the colourant is selected from one or more dyes, pigments, optical brighteners or mixtures thereof.

6. The method according to claim 5 wherein the colourant is one or more dyes selected from anionic, cationic, acidic, basic, amphoteric, reactive, direct, chrome-mordant, pre-metallised and sulphur dyes.

7. The method according to claim 1 wherein the animal substrate is moistened by wetting so as to achieve a water to animal substrate ratio of from about 1000:1 to about 1:1000 w/w.

8. The method of claim 7 wherein the animal substrate is moistened by wetting so as to achieve a water to animal substrate ratio of from about 1:100 to about 1:1 w/w.

9. The method of claim 1 wherein the ratio of water to animal substrate in the treatment formulation is from at least 1:40 w/w to about 10:1 w/w.

10. The method according to claim 1 wherein the ratio of water to solid particulate material in the treatment formulation is from about 1000:1 to about 1:1000 w/w.

11. The method according to claim 10 wherein the ratio of water to solid particulate material in the treatment formulation is from about 1:1 to about 1:100 w/w.

12. The method according to claim 1 wherein the ratio of the solid particulate material to the animal substrate is from about 1000:1 to about 1:1000 w/w.

13. The method according to claim 12 wherein the ratio of the solid particulate material to the animal substrate is from about 5:1 to about 1:5 w/w.

14. The method according to claim 1 wherein the ratio of the solid particulate material to the animal substrate to water is from about 1:1:1 to about 50:50:1 w/w.

15. The method according to claim 1 comprising adding a first portion of the aqueous treatment formulation and agitating the moistened animal substrate with the treatment formulation in the sealed apparatus before introducing the solid particulate material.

16. The method according to claim 1 comprising agitating the moistened animal substrate with the solid particulate material in the sealed apparatus before adding the aqueous treatment formulation.

17. The method of claim 2 comprising recirculating the solid particulate material into the treatment chamber via recirculation means.

18. The method of claim 1 further comprising, before or after said agitating the moistened animal substrate with an aqueous treatment formulation and a solid particulate material, subjecting said animal substrate to at least one further treatment selected from tanning, retanning, cleaning, curing, beamhouse treatments including soaking, liming, unhairing, scudding, fleshing, deliming, bating, pickling and fatliquoring, enzyme treatment, dye fixing, and one or more additional colourant treatments.

19. The method of claim 1 wherein the treatment formulation comprises at least 5% w/w water.

20. The method of claim 19 wherein the treatment formulation comprises not more than 99.9% w/w water.

21. The method of claim 1 wherein the treatment formulation comprises water and no organic solvent.

22. The method of claim 1 wherein the aqueous treatment formulation comprising at least one colourant has a pH less than 7.

23. The method of claim 22 wherein the method comprises a dye penetration stage and a subsequent dye fixing stage and wherein the treatment formulation comprising at least one colourant has a pH less than 7 in the dye penetration stage and a pH less than 7 in the dye fixing stage.

24. The method of claim 22 wherein the method comprises a dye penetration stage and a subsequent dye fixing stage and wherein the treatment formulation comprising at least one colourant has a pH less than 7 in the dye penetration stage and a pH greater than 7 in the dye fixing stage.

25. The method of claim 1 wherein the method comprises no step configured to coat the solid particulate material with the colourant prior to contact of the particulate material with the animal substrate.

26. The method of claim 2 wherein the solid particulate material is uncoated, washed or cleaned and introduced into the treatment chamber.

27. The method of claim 26 wherein said uncoated, washed or cleaned solid particulate material is introduced in the presence of said animal substrate.

28. The method of claim 1 wherein the particles are re-used at least once in a subsequent method for treating an animal substrate comprising: agitating a moistened animal substrate with said aqueous treatment formulation and said solid particulate material in a sealed apparatus.

29. The method of claim 1 including the step of subjecting the particles to a cleaning procedure after the treatment of the animal substrate.

30. The method of claim 2 wherein the solid particulate material is recovered from the treatment chamber after the treatment of the animal substrate.

31. The method of claim 1 wherein the solid particulate material does not penetrate the surface of the animal substrate.

32. The method according to claim 1 wherein the polymeric or non-polymeric particles have an average density of 0.5 to 20 g/cm$^3$.

33. The method according to claim 1 wherein the polymeric or non-polymeric particles have an average density of 0.5 to 3.5 g/cm$^3$.

34. The method according to claim 1 wherein the polymeric or non-polymeric particles have an average particle diameter of from 1 mm to 500 mm.

35. The method according to claim 1 wherein the polymeric or non-polymeric particles have a length of from 1 mm to 500 mm.

36. The method according to claim 1 wherein the polymeric particles have an average volume of from 5 to 275 mm$^3$.

37. The method according to claim 1 wherein the polymeric or non-polymeric particles comprise beads.

38. The method according to claim 1 wherein the treatment formulation comprises one or more components selected from the group consisting of: solvents, surfactants, cross-linking agents, preservation agents, metal complexes, corrosion inhibitors, complexing agents, biocides, builders, catalysts, chelating agents, dispersants, perfumes, enzymes, oils, waxes, waterproofing agents, flame retardants, stain repellants, reducing agents, acids, bases, neutralizing agents, polymers, resins, oxidising agents and bleaches.

39. The method according to claim 1 wherein the non-polymeric particles comprise particles of ceramic material; refractory material; igneous, sedimentary or metamorphic minerals; composites; metal; glass; or wood.

40. The method according to claim 1 wherein the treatment formulation comprises two or more portions and wherein each portion of the treatment formulation may be the same or different.

41. The method according to claim 1 wherein the treatment formulation comprises at least one surfactant.

42. The method according to claim 1 wherein the treatment formulation comprises at least one preservation agent.

43. The method according to claim 1 wherein the treatment formulation comprises at least one tanning agent.

44. The method according to claim 1 wherein the method consists of a treatment cycle comprising one or more phases or stages.

45. The method according to claim 1 comprising the steps of:

a) agitating the moistened animal substrate with a first portion of the aqueous treatment formulation and a solid particulate material in a sealed apparatus;
b) removing the solid particulate material; and
c) adding a second portion of the aqueous treatment formulation and agitating the moistened animal substrate with the aqueous treatment formulation.

46. The method according to claim 2 wherein the treatment chamber comprises perforations.

47. The method according to claim 1 wherein the sealed apparatus comprises one or more dosing compartments suitable for containing one or more portions of the treatment formulation.

48. The method according to claim 47 wherein the treatment formulation comprises one or more portions and the sealed apparatus is adapted to dispense the one or more portions of the treatment formulation at one or more predetermined time points.

49. The method according to claim 1, wherein the animal substrate is for human use.

50. A method as claimed in claim 1 comprising one or more subsequent processing steps selected from drying, coating, lacquering, polishing, cutting, shaping, forming, embossing, punching, gluing, sewing, stapling and packaging the treated animal substrate or one or more parts thereof.

51. A method as claimed in claim 50 wherein said one or more subsequent processing steps comprise producing a finished leather substrate.

52. A method as claimed in claim 50 wherein said one or more subsequent processing steps comprise producing a finished leather good.

53. A method as claimed in claim 52 wherein said finished leather good is selected from one or more of: articles of apparel and personal accessories, footwear, bags, briefcases and suitcases, saddlery, furniture and upholstered articles, sporting goods and accessories, pet collars and leashes, and vehicle interior coverings.

54. An animal substrate obtained by the method of claim 1.

55. A finished leather good or a component of a finished leather good obtained by a method according to claim 1.

56. The method according to claim 1, wherein the polymeric or non-polymeric particles have an average mass of 1 mg to 100 g.

57. A method according to claim 1, wherein at least one phase or stage of the method is carried out at a temperature of between about 0° C. and about 100° C.

58. The method of claim 29, wherein said particles are cleaned intermittently.

59. The method of claim 58, wherein the particles are agitated during cleaning.

60. The method of claim 58, wherein the particles are cleaned after every 10, after every 5, after every 3, after every 2 or after every 1 agitation step(s).

61. The method of claim 58, wherein the particle cleaning step comprises washing the particles with a cleaning formulation which is water, an organic solvent or a mixture thereof.

62. The method of claim 61, wherein the cleaning formulation comprises one or more cleaning agents to aid the removal of any contaminants.

63. The method of claim 61, wherein said cleaning agents are selected from surfactants, detergents, dye transfer agents, biocides, fungicides, builders and metal chelating agents.

64. The method according to claim 1 wherein the polymeric or non-polymeric particles have an average particle diameter of from 0.5 mm to 15 mm, or from 0.5 mm to 6.0 mm.

65. The method according to claim 1 wherein the polymeric or non-polymeric particles have an average particle diameter of from 0.5 mm to 6.0 mm.

66. The method according to claim 1 wherein the polymeric or non-polymeric particles have a length of from 0.5 mm to 15 mm.

67. The method according to claim 1 wherein the polymeric or non-polymeric particles have a length of from 0.5 mm to 6.0 mm.

68. The method according to claim 1, wherein the polymeric or non-polymeric particles have an average mass of 5 mg to 100 mg.

69. A method according to claim 1, wherein at least one phase or stage of the method is carried out at a temperature of from 0 to 60° C.

70. A method according to claim 1, wherein at least one phase or stage of the method is carried out at a temperature of from about 20° C. to about 60° C.

* * * * *